US011994127B2

(12) United States Patent
Okamoto et al.

(10) Patent No.: US 11,994,127 B2
(45) Date of Patent: May 28, 2024

(54) MULTISTAGE COMPRESSION SYSTEM

(71) Applicant: DAIKIN INDUSTRIES, LTD., Osaka (JP)

(72) Inventors: Daisuke Okamoto, Osaka (JP); Naoto Tomioka, Osaka (JP); Mikio Kajiwara, Osaka (JP); Yohei Nishide, Osaka (JP); Yousuke Ohnishi, Osaka (JP); Masaaki Adachi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 500 days.

(21) Appl. No.: 17/280,078

(22) PCT Filed: Sep. 25, 2019

(86) PCT No.: PCT/JP2019/037669
§ 371 (c)(1),
(2) Date: Mar. 25, 2021

(87) PCT Pub. No.: WO2020/067194
PCT Pub. Date: Apr. 2, 2020

(65) Prior Publication Data

US 2021/0340981 A1 Nov. 4, 2021

(30) Foreign Application Priority Data

Sep. 28, 2018 (JP) ..... 2018-185073
Nov. 27, 2018 (JP) ..... 2018-221585
(Continued)

(51) Int. Cl.
*F04C 23/02* (2006.01)
*F04C 18/356* (2006.01)
(Continued)

(52) U.S. Cl.
CPC ..... *F04C 23/02* (2013.01); *F04C 18/356* (2013.01); *F04C 18/3564* (2013.01);
(Continued)

(58) Field of Classification Search
CPC ..... F04C 23/008; F04C 23/001; F04C 29/02; F04C 29/04; F04C 18/3564; F04C 18/356;
(Continued)

(56) References Cited

U.S. PATENT DOCUMENTS 5,236,311 A 8/1993 Lindstrom
11,428,225 B2 * 8/2022 Okamoto ..... F04C 29/02
(Continued)

FOREIGN PATENT DOCUMENTS

DE 10 2013 014 543 A1 3/2015
EP 2 172 653 A1 4/2010
(Continued)

OTHER PUBLICATIONS

Fang Guiyin, "The New Refrigeration Repair Technology and Examples", People Post Press, pp. 76-78, Dec. 31, 2000, China.
(Continued)

*Primary Examiner* — Peter J Bertheaud
(74) *Attorney, Agent, or Firm* — Global IP Counselors, LLP

(57) ABSTRACT

A multistage compression system uses refrigerant and oil. The multistage compression system includes a low-stage compressor that compresses the refrigerant, a high-stage compressor that further compresses the refrigerant compressed by the low-stage compressor, and an oil return pipe that returns the oil discharged by the high-stage compressor or the oil in the high-stage compressor to the low-stage compressor. The low-stage compressor has a rotary compression part that compresses the refrigerant, a motor that
(Continued)

drives the compression part, and a container housing the compression part and the motor. The motor is disposed above the compression part. The oil return pipe is connected to a space below the motor inside the container.

22 Claims, 14 Drawing Sheets

(30) Foreign Application Priority Data

Dec. 13, 2018 (JP) ..... 2018-233787
Dec. 13, 2018 (JP) ..... 2018-233790

(51) Int. Cl.

| | |
|---|---|
| ***F04C 23/00*** | (2006.01) |
| ***F04C 29/02*** | (2006.01) |
| ***F04C 29/04*** | (2006.01) |
| ***F25B 1/04*** | (2006.01) |
| ***F25B 1/10*** | (2006.01) |
| ***F25B 13/00*** | (2006.01) |
| ***F25B 31/00*** | (2006.01) |

(52) U.S. Cl.
CPC ..... *F04C 23/00* (2013.01); *F04C 23/001* (2013.01); *F04C 23/008* (2013.01); *F04C 29/02* (2013.01); *F04C 29/04* (2013.01); *F25B 1/04* (2013.01); *F25B 1/10* (2013.01); *F25B 13/00* (2013.01); *F25B 31/004* (2013.01); *F04C 2210/222* (2013.01); *F04C 2240/30* (2013.01); *F04C 2240/804* (2013.01); *F25B 2400/04* (2013.01); *F25B 2400/072* (2013.01); *F25B 2400/13* (2013.01); *F25B 2400/23* (2013.01); *F25B 2700/21152* (2013.01)

(58) Field of Classification Search
CPC .... F04C 23/00; F04C 23/02; F04C 2210/222; F04C 2240/30; F04C 2240/804; F25B 1/10; F25B 31/004; F25B 2400/13; F25B 2400/23; F25B 1/04; F25B 2700/21152; F25B 13/00; F25B 2400/04; F25B 2400/072
See application file for complete search history.

(56) References Cited

U.S. PATENT DOCUMENTS

| | | | | |
|---|---|---|---|---|
| 2007/0245768 | A1 | 10/2007 | Sakae et al. | |
| 2008/0152524 | A1 | 6/2008 | Kishi et al. | |
| 2011/0036110 | A1 | 2/2011 | Fujimoto et al. | |
| 2017/0284706 | A1* | 10/2017 | Ozu ..... | F25B 31/002 |

FOREIGN PATENT DOCUMENTS

| | | | |
|---|---|---|---|
| EP | 2 863 151 | A2 | 4/2015 |
| EP | 3 136 020 | A1 | 3/2017 |
| JP | 4-371759 | A | 12/1992 |
| JP | 7-260263 | A | 10/1995 |
| JP | 7-301465 | A | 11/1995 |
| JP | 2001-272122 | A | 10/2001 |
| JP | 2004-285854 | A | 10/2004 |
| JP | 2006-258002 | A | 9/2006 |
| JP | 2006-348951 | A | 12/2006 |
| JP | 2007-9922 | A | 1/2007 |
| JP | 2007-93017 | A | 4/2007 |
| JP | 2008-175066 | A | 7/2008 |
| JP | 2008-261227 | A | 10/2008 |
| JP | 2009-79820 | A | 4/2009 |
| JP | 2009-133584 | A | 6/2009 |
| JP | 2011-202817 | A | 10/2011 |
| JP | 2011-214758 | A | 10/2011 |
| JP | 2012-180963 | A | 9/2012 |
| JP | 2013-181736 | A | 9/2013 |
| JP | 2015-34536 | A | 2/2015 |
| JP | 2015-78804 | A | 4/2015 |
| JP | 2017-44420 | A | 3/2017 |
| JP | 2018-31263 | A | 3/2018 |

OTHER PUBLICATIONS

International Preliminary Report of corresponding PCT Application No. PCT/JP2019/037669 dated Apr. 8, 2021.
European Search Report of corresponding EP Application No. 19 86 6259.5 dated Sep. 14, 2021.
European Search Report of corresponding EP Application No. 19 86 6258.7 dated Oct. 21, 2021.
European Search Report of corresponding EP Application No. 19 86 7267 dated Oct. 5, 2021.
European Search Report of corresponding EP Application No. 19 86 4032.8 dated Sep. 29, 2021.
International Search Report of corresponding PCT Application No. PCT/JP2019/037669 dated Dec. 10, 2019.

* cited by examiner

MULTISTAGE COMPRESSION SYSTEM

CROSS-REFERENCE TO RELATED APPLICATIONS

This U.S. National stage application claims priority under 35 U.S.C. § 119(a) to Japanese Patent Application Nos. 2018-185073, filed in Japan on Sep. 28, 2018, 2018-221585, filed in Japan on Nov. 27, 2018, 2018-233787 and 2018-233790, filed in Japan on Dec. 13, 2018 the entire contents of which are hereby incorporated herein by reference.

BACKGROUND

Field of the Invention

A multistage compression system using refrigerant and oil.

Background Information

In a refrigeration apparatus, a multistage compression mechanism using a plurality of compressors is recommended and used depending on working refrigerant. In the multistage compression mechanism using the plurality of compressors, it is important to control refrigerator oil in an appropriate amount in the plurality of compressors. In other words, the oil is to be controlled not to be extremely unevenly distributed in one compressor.

In JP 2008-261227 A, a low-stage oil drain passage in a low-stage compressor and an oil return passage for returning oil discharged in a high-stage compressor to a suction pipe of the low-stage compressor are provided in order to keep an oil level of the low-stage and high-stage compressors constant.

SUMMARY

However, returning the oil discharged by the high-stage compressor to a refrigerant suction side of the low-stage compressor can cause the following two losses.

A first loss is a heat loss. The oil discharged by the high-stage compressor has a high temperature. Mixing the high-temperature oil with the sucked refrigerant causes the heat loss in which a temperature of the sucked refrigerant is raised. A second loss is a pressure loss. The pressure loss occurs in which the high-pressure oil is mixed with the low-pressure sucked refrigerant (gas).

A multistage compression system according to a first aspect uses refrigerant and oil. The multistage compression system has a low-stage compressor, a high-stage compressor, and an oil return pipe. The low-stage compressor compresses the refrigerant. The high-stage compressor further compresses the refrigerant compressed by the low-stage compressor. The oil return pipe returns the oil discharged by the high-stage compressor or the oil in the high-stage compressor to the low-stage compressor. Further, the low-stage compressor has a compression part, a motor, and a container. The compression part compresses the refrigerant. The compression part is a rotary type. The motor drives the compression part. The motor is disposed above the compression part. The container houses the compression part and the motor. The oil return pipe is connected to a space below the motor inside the container. The space below the motor includes a space beside the motor.

In the multistage compression system according to the first aspect, the oil return pipe is connected to the space below the motor in the container, and thus heat and pressure losses when the oil is returned to the suction pipe can be reduced.

A multistage compression system according to a second aspect is the system according to the first aspect, in which the compression part is provided with a compression chamber. The compression chamber introduces the refrigerant and compresses the refrigerant. The oil return pipe is connected to above the compression chamber in the container. When there are a plurality of compression chambers having different heights in the compressor, the compression chamber indicated here refers to a lowest compression chamber.

In the multistage compression system according to the second aspect, the oil return pipe is connected to a position above the compression chamber of the container. This increases a possibility of supplying the oil to above an oil reservoir of the low-stage compressor, and a problem of supplying the oil below a liquid level or, in other words, a problem of foaming is likely to be avoided.

A multistage compression system according to a third aspect is the system according to the first or second aspect, further including an accumulator and a suction pipe. The accumulator is for separating a liquid component of the refrigerant flowing into the low-stage compressor. The suction pipe connects an inside of the accumulator and the compression part. The suction pipe is provided with an oil return hole. The oil return hole is for sending the oil inside the accumulator to the compression part. A flow path cross-sectional area of the oil return pipe is larger than an area of the oil return hole.

The oil in the accumulator is gradually sent to the low-stage compressor through the oil return hole.

In the multistage compression system according to the third aspect, the flow path cross-sectional area of the oil return pipe is larger than the area of the oil return hole, and thus the oil return pipe can supply the oil to the compression part more quickly than the oil is supplied from the oil return hole.

A multistage compression system according to a fourth aspect is the system of any of the first to third aspects, further including an oil cooler. The oil cooler is disposed in a middle of the oil return pipe.

The multistage compression system according to the fourth aspect further includes the oil cooler, and thus the cooled oil can be returned to the low-stage compressor by the oil return pipe, and an energy loss can be reduced.

A multistage compression system according to a fifth aspect is the system according to any of the first to fourth aspects, further including a decompressor. The decompressor is disposed in a middle of the oil return pipe.

In the multistage compression system according to the fifth aspect, the decompressed oil can be returned to the low-stage compressor by the oil return pipe, and the energy loss can be reduced.

A multistage compression system according to a sixth aspect is the system according to any of the first to fifth aspects, further including a flow rate adjusting valve. The flow rate adjusting valve is disposed in a middle of the oil return pipe.

In the multistage compression system according to the sixth aspect, the flow rate adjusting valve is disposed in a middle of the oil return pipe, and thus a flow rate of the oil returned to the low-stage compressor can be adjusted.

A multistage compression system according to a seventh aspect is the system according to any of the first to sixth aspects, in which the low-stage compressor further includes an oil guide. The oil guide is disposed in the container so as to face an outlet of the oil return pipe.

In the multistage compression system of the seventh aspect, the oil guide is disposed so as to face the outlet of the oil return pipe, and this allows the oil to collide with the oil guide and fall into the oil reservoir.

A multistage compression system according to an eighth aspect is the system according to the seventh aspect, in which the oil return pipe is disposed such that an angle of an oil introduction part of the oil return pipe into the container is within 15° above and below a horizontal.

In the multistage compression system according to the eighth aspect, the angle of the oil introduction part of the oil return pipe into the container is close to the horizontal, and this makes it easy to allow the oil to collide with the oil guide, change a direction of the oil, and supply the oil to the oil reservoir.

A multistage compression system according to a ninth aspect is the system according to the seventh or eighth aspect, in which the oil guide is disposed within 25% of an inner diameter D of a horizontal cross section of the container from an inner circumference of the container.

In the multistage compression system according to the ninth aspect, the oil guide is disposed near an inner surface of the container, and this allows the oil introduced from the oil return pipe to collide with the oil guide in a short distance, and the direction of the oil to be controlled easily.

A multistage compression system according to a tenth aspect is the system according to any of the seventh to ninth aspects, in which the oil guide is a plate-shaped member extending vertically.

In the multistage compression system according to the tenth aspect, the oil guide is a plate-shaped member extending vertically, and this can increase the area of the part where the oil from the oil return pipe to the inside of the container collides.

A multistage compression system according to an eleventh aspect is the system according to the tenth aspect, in which the motor includes an insulator. The oil guide is a part continuous to the insulator and extending downward from the insulator.

A multistage compression system according to a twelfth aspect is the system according to any of the seventh to ninth aspects, in which the motor includes a stator. The oil guide is an outer surface of the stator.

A multistage compression system according to a thirteenth aspect is the system according to any of the seventh to ninth aspects, in which the oil guide is a part of a pipe through which the oil passes, and is a bent part of the pipe.

A multistage compression system according to a fourteenth aspect is the system according to any of the first to sixth aspects, in which the compression part has a piston and a cylinder. The piston is driven by the motor. The cylinder houses the piston. The oil return pipe is connected to the container. A connection position of the oil return pipe to the container is a position where the oil having flowed through the oil return pipe is applied to the cylinder or a member in contact with upper and lower parts of the cylinder. Here, the member in contact with the upper and lower parts of the cylinder includes a member in direct contact with the cylinder and a member in contact with the member in direct contact with the cylinder.

In the multistage compression system according to the fourteenth aspect, the oil having a high-temperature from the oil return pipe can be applied to the cylinder or the member in contact with the upper and lower parts of the cylinder, and thus the cylinder having a relatively large heat capacity can be heated. As a result, a temperature difference between the cylinder and the piston can be suppressed.

A multistage compression system according to the fifteenth aspect is the system according to the fourteenth aspect, in which the compression part further includes a vane. The vane partitions a space between the piston and the cylinder. The connection position of the oil return pipe to the container is, in a top view, within a range of 120° in a rotation direction of the motor from a rotation center of the motor, where a direction of a center of a cutout part for housing the vane on an inner circumference of the cylinder is 0°.

The multistage compression system according to the fifteenth aspect can heat the cylinder near a suction hole of the compression chamber. This makes it possible to heat the cylinder near the piston, which is heated by the suction refrigerant, and makes it easy to eliminate the temperature difference between the cylinder and the piston.

A multistage compression system according to a sixteenth aspect is the system according to the fourteenth or fifteenth aspect, in which the oil return pipe is connected to the container such that the oil having flowed through the oil return pipe is applied from above to the cylinder or the member in contact with the upper and lower parts of the cylinder.

The multistage compression system according to the sixteenth aspect can heat the cylinder over a large area.

A multistage compression system according to a seventeenth aspect is the system according to the fourteenth or fifteenth aspect, in which the connection position of the oil return pipe to the container is as high as the cylinder.

The multistage compression system according to the seventeenth aspect can heat a side surface of the cylinder with the oil. The cylinder can be heated directly, thereby facilitating control of a temperature of the cylinder.

A multistage compression system according to an eighteenth aspect is the system according to the seventeenth aspect, in which the oil return pipe has a distal end extending closer to the cylinder than the connection position to the container.

In the multistage compression system according to the eighteenth aspect, the oil return pipe has the distal end extending closer to the cylinder than the connection position to the container, and thus the cylinder can be heated more reliably.

A multistage compression system according to a nineteenth aspect is the system according to the seventeenth or eighteenth aspect, in which an oil outlet of the oil return pipe in the container is provided so as to face the cylinder or a member in contact with upper and lower parts of the cylinder.

In the multistage compression system according to the nineteenth aspect, the oil outlet of the oil return pipe in the container is disposed to face a vicinity of the cylinder, and this allows the high-temperature oil to collide with the vicinity of the cylinder more reliably.

A multistage compression system according to a twentieth aspect is the system according to any of the first to nineteenth aspects, in which oil incompatible with carbon dioxide is used.

In the multistage compression system according to the twentieth aspect, the refrigerant and the oil are incompatible with each other, thereby making it easy to separate the refrigerant and the oil and introduce mainly the oil into the low-stage compressor.

DETAILED DESCRIPTION OF EMBODIMENT(S)

First Embodiment (1) Refrigerant Circuit of Refrigeration Apparatus 1

(1-1) Entire Refrigerant Circuit of Refrigeration Apparatus 1

Figure 1:
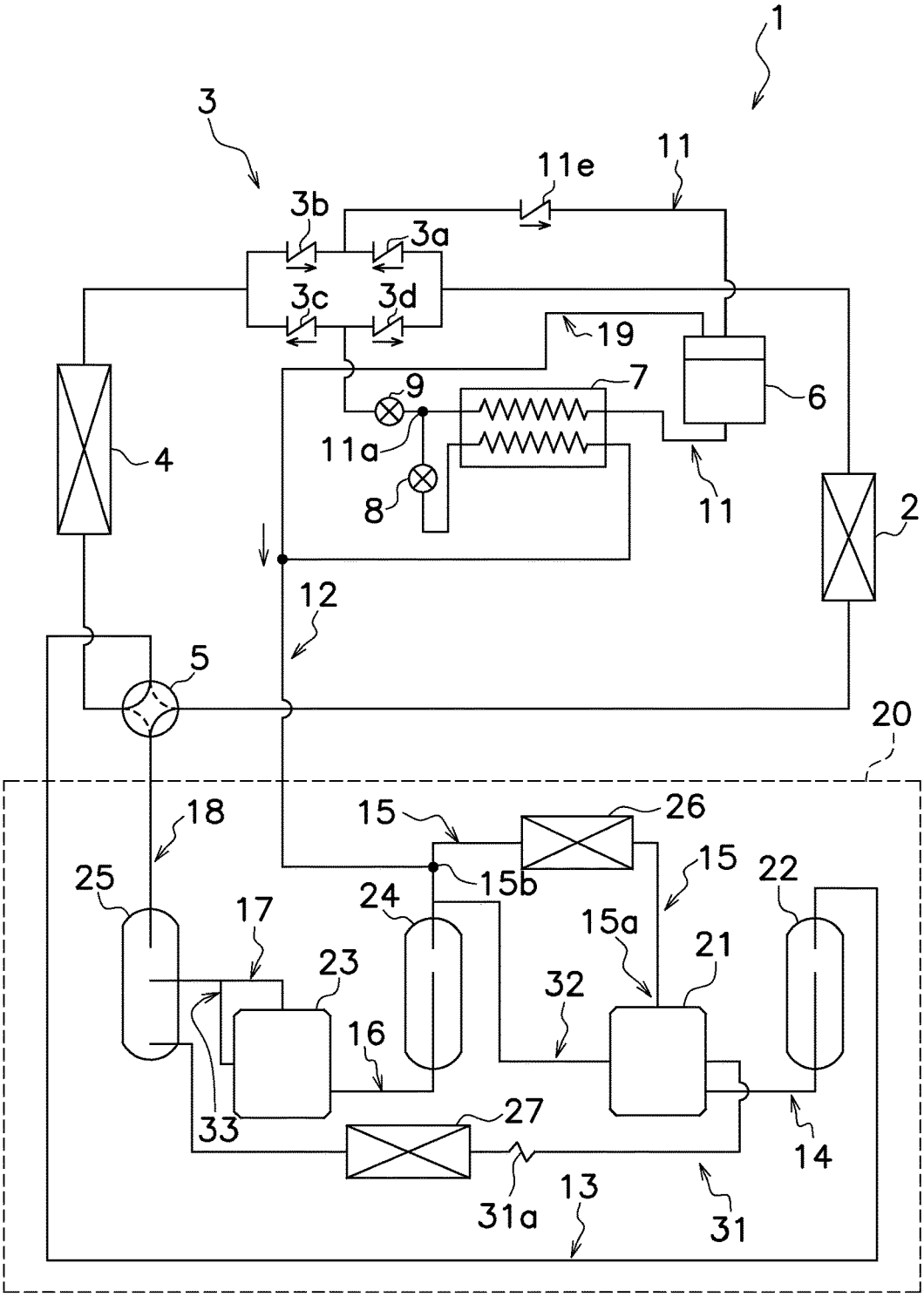
FIG. 1 is a refrigerant circuit diagram of a refrigeration apparatus 1 according to a first embodiment.

FIG. 1 shows a refrigerant circuit configuration of a refrigeration apparatus 1 according to a first embodiment. The refrigeration apparatus 1 according to the present embodiment is an apparatus that performs a two-stage compression refrigeration cycle using carbon dioxide as refrigerant that operates in a supercritical region. The refrigeration apparatus 1 according to the present embodiment can be used for an air conditioner for heating and cooling, an air conditioner dedicated for cooling, a water cooler and heater, a refrigerator, a refrigeration storage apparatus, and the like.

The refrigeration apparatus 1 according to the present embodiment has a multistage compression system 20, a four-way switching valve 5, a heat source side heat exchanger 2, a bridge circuit 3, expansion mechanisms 8 and 9, a use side heat exchanger 4, and an economizer heat exchanger 7.

The multistage compression system 20 compresses the refrigerant. Gas refrigerant is introduced into a first accumulator 22 at an inlet of a low-stage compressor 21 via the four-way switching valve 5 and a refrigerant pipe 13. The refrigerant is compressed by the low-stage compressor 21 and a high-stage compressor 23, and reaches the four-way switching valve 5 via a pipe 18.

The four-way switching valve 5 switches directions in which the refrigerant from the multistage compression system 20 flows to the heat source side heat exchanger 2 or to the use side heat exchanger 4. For example, when the refrigeration apparatus 1 is an air conditioner and is performing a cooling operation, the refrigerant flows from the four-way switching valve 5 to the heat source side heat exchanger 2 (condenser). The refrigerant flowing through the heat source side heat exchanger 2 (condenser) reaches a receiver 6 via a check valve 3*a* of the bridge circuit 3, a pipe 11, and a check valve 11*e*. The liquid refrigerant continues to flow from the receiver 6 through the pipe 11, is decompressed by the expansion mechanism 9, and flows to the use side heat exchanger 4 (evaporator) via a check valve 3*c* of the bridge circuit 3. The refrigerant heated by the use side heat exchanger 4 (evaporator) passes through the four-way switching valve 5, and is compressed again by the multistage compression system 20. On the other hand, during a heating operation, the refrigerant flows from the four-way switching valve 5 to the use side heat exchanger 4 (condenser), a check valve 3*b* of the bridge circuit 3, the pipe 11, the receiver 6, the expansion mechanism 9, a check valve 3*d* of the bridge circuit 3, the use side heat exchanger 4 (evaporator), and the four-way switching valve 5 in this order.

The economizer heat exchanger 7 is disposed between the receiver 6 and the expansion mechanism 9 in a middle of the refrigerant pipe 11. At a branch 11*a* of the pipe 11, a part of the refrigerant branches and is decompressed to an intermediate pressure at the expansion mechanism 8. The intermediate-pressure refrigerant is heated by the high-pressure refrigerant flowing through the pipe 11 in the economizer heat exchanger 7 and injected into a merging part 15*b* of an intermediate pressure of the multistage compression system 20 via an intermediate injection pipe 12. Further, a gas component of the refrigerant from the receiver 6 merges into the intermediate injection pipe 12 via the pipe 19.

(1-2) Flow of Refrigerant and Oil in Multistage Compression System 20

As shown in FIG. 1, the multistage compression system 20 according to the present embodiment includes the first accumulator 22, the low-stage compressor 21, an intercooler 26, a second accumulator 24, the high-stage compressor 23, an oil separator 25, an oil return pipe 31, an oil cooler 27, and a decompressor 31*a*.

In the present embodiment, the refrigerant compressed by the low-stage compressor 21 is further compressed by the high-stage compressor 23. The compressors 21 and 23 are provided with the accumulator 22 and the accumulator 24, respectively. The accumulators 22 and 24 play a role of storing the refrigerant before entering the compressor once and preventing the liquid refrigerant from being sucked into the compressor.

Next, a flow of the refrigerant and the oil in the multistage compression system 20 according to the present embodiment will be described with reference to FIG. 1.

In the present embodiment, the low-pressure gas refrigerant heated by the evaporator (use side heat exchanger 4 or heat source side heat exchanger 2) flows to the first accumulator 22 via the refrigerant pipe 13. The gas refrigerant of the first accumulator 22 flows to the low-stage compressor 21 via a suction pipe 14. The refrigerant compressed by the low-stage compressor 21 is discharged from a discharge pipe 15*a*, flows through an intermediate pressure refrigerant pipe 15, and reaches the second accumulator 24.

The intercooler 26 is disposed in a middle of the intermediate pressure refrigerant pipe 15. The intercooler 26 is a heat exchanger that cools the intermediate-pressure refrigerant with, for example, outdoor air. The intercooler 26 may be disposed adjacent to the heat source side heat exchanger 2 and exchange heat with air by a common fan. The intercooler 26 enhances efficiency of the refrigeration apparatus 1 by cooling the intermediate-pressure refrigerant.

Further, the intermediate-pressure refrigerant is injected into the merging part 15*b* of the intermediate pressure refrigerant pipe 15 from the intermediate injection pipe 12. In the present embodiment, the merging part 15*b* of the intermediate injection pipe 12 with the pipe 15 is disposed downstream of the intercooler 26. A temperature of the refrigerant injected by intermediate injection is lower than a temperature of the refrigerant flowing through the pipe 15. Thus, the intermediate injection lowers the temperature of the refrigerant flowing through the pipe 15 and improves the efficiency of the refrigeration apparatus 1.

The multistage compression system 20 according to the present embodiment further includes an oil discharge pipe 32 that discharges excess oil from the low-stage compressor. The oil discharge pipe 32 connects the low-stage compressor 21 and the pipe 15 of an intermediate pressure. The oil discharge pipe 32 discharges not only the excess oil accumulated in an oil reservoir of the low-stage compressor but also excess refrigerant accumulated in the oil reservoir. A connection part of the oil discharge pipe 32 with the intermediate pressure refrigerant pipe 15 is a part downstream of the intercooler 26 and the merging part 15*b* of the intermediate injection.

The refrigerant sent to the second accumulator 24 by the pipe 15 is introduced into the high-stage compressor 23 from a suction pipe 16. The refrigerant is compressed in the high-stage compressor 23 to a high pressure, and is discharged to a discharge pipe 17.

The refrigerant discharged to the discharge pipe 17 flows to the oil separator 25. The oil separator 25 separates the refrigerant from the oil. The separated oil is returned to the low-stage compressor 21 via an oil return pipe 31.

The multistage compression system 20 according to the present embodiment further includes an oil discharge pipe 33 that discharges excess oil from the high-stage compressor. The oil discharge pipe 33 connects the high-stage compressor 23 and the discharge pipe 17 of the high-stage compressor 23.

The decompressor 31*a* is disposed in a middle of the oil return pipe 31. The decompressor 31*a* is for decompressing the high-pressure oil discharged from the oil separator 25. Specifically, for example, a capillary tube is used for the decompressor 31*a*.

The oil cooler 27 is disposed in the middle of the oil return pipe 31. The oil cooler 27 is a heat exchanger that cools the oil flowing through the oil return pipe 31, for example, with the outdoor air. The oil cooler 27 is for cooling the high-temperature oil discharged from the oil separator 25. The oil cooler 27 may be disposed, for example, near the heat source side heat exchanger 2 and may exchange heat with air by a common fan. The oil cooler 27 may be disposed, for example, below the heat source side heat exchanger 2.

The oil (refrigerator oil) according to the present embodiment is not limited as long as the oil is refrigerator oil used as $CO_2$ refrigerant, but oil insoluble (incompatible) with the $CO_2$ refrigerant is particularly suitable. Examples of refrigerator oil include polyalkylene glycols (PAG) and polyester esters (POE).

The refrigeration apparatus 1 according to the present embodiment performs two-stage compression with two compressors. Two or more stages of compression may be performed using three or more compressors. Further, three or more stages of compression may be performed.

(2) Configuration of Compressor and Pipe and Device Connected to Compressor

Both the low-stage compressor 21 and the high-stage compressor 23 according to the present embodiment are two-cylinder and oscillating rotary compressors. The compressors 21 and 23, which have almost the same configuration, will be described in detail here using the low-stage compressor 21.

Figure 2:
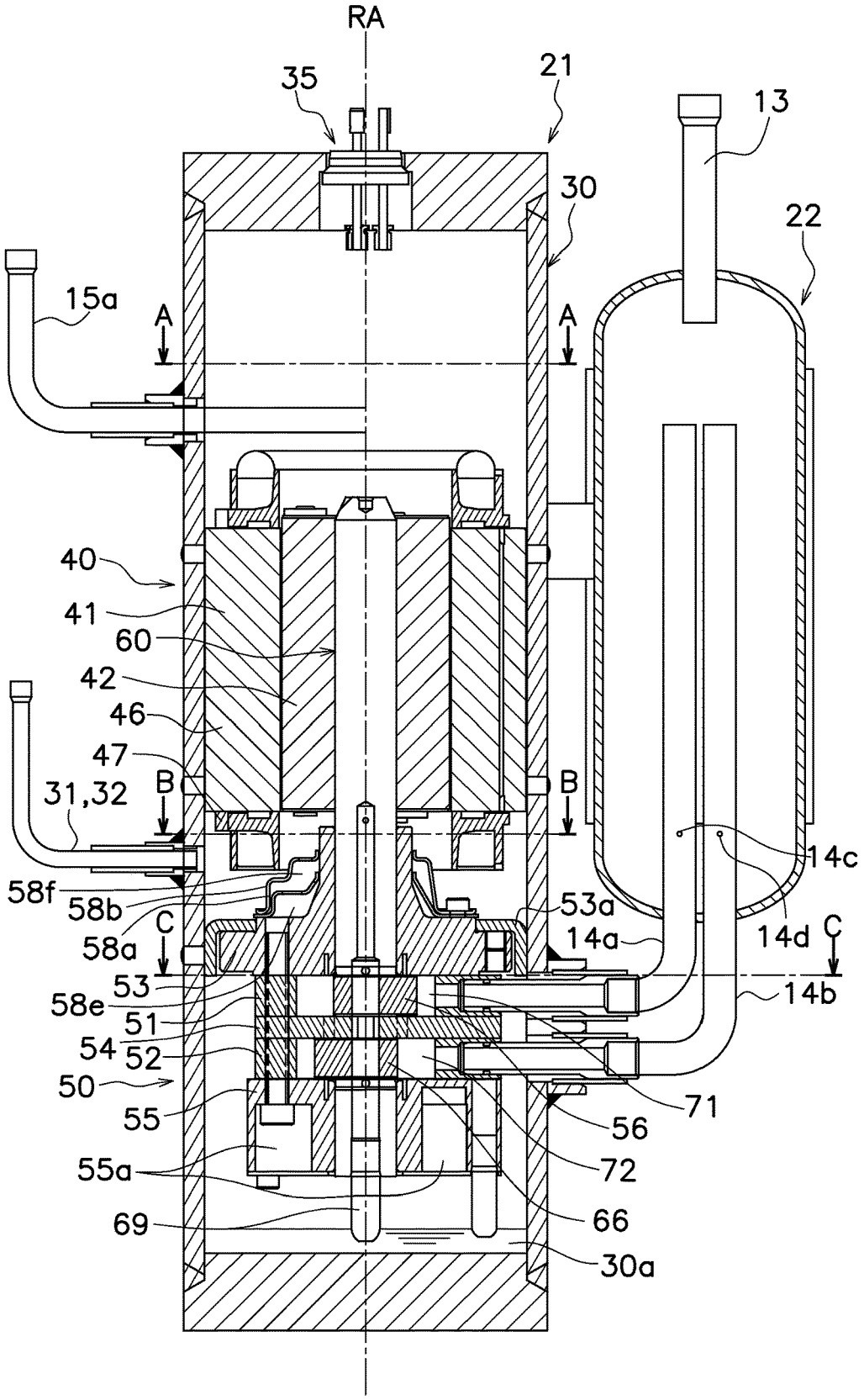
FIG. 2 is a vertical sectional view of a low-stage compressor 21 according to the first embodiment.
Figure 3:
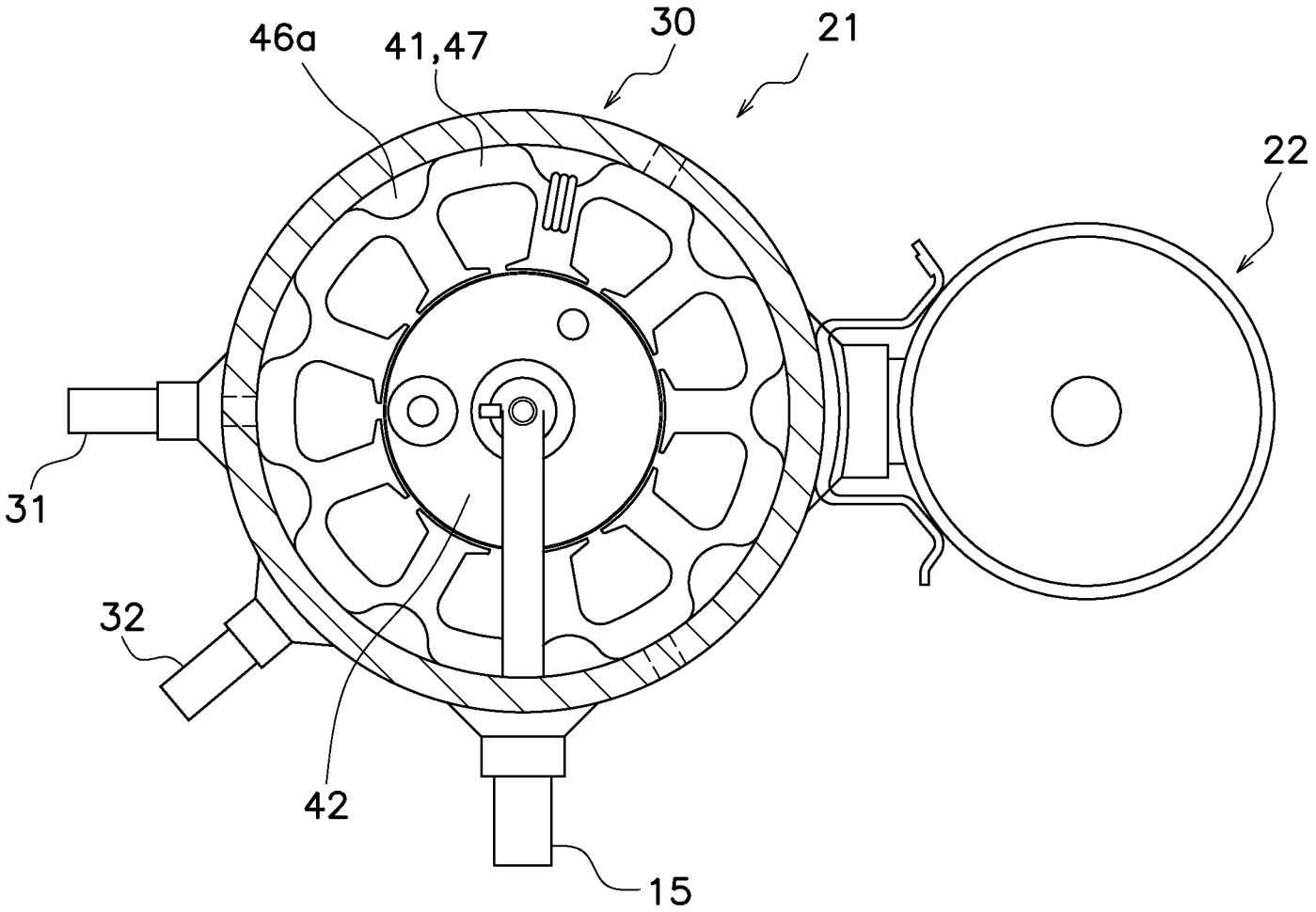
FIG. 3 is a sectional view taken along line A-A of the low-stage compressor 21 according to the first embodiment.
Figure 4:
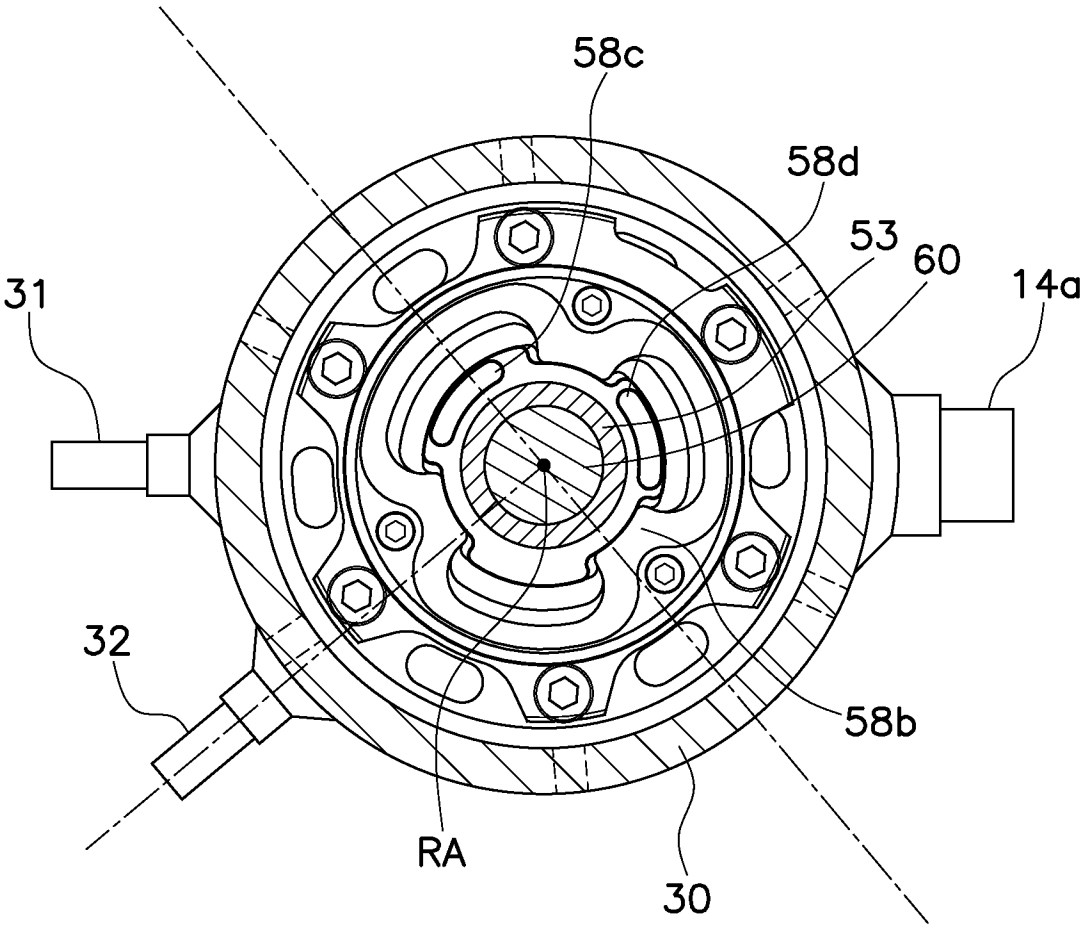
FIG. 4 is a sectional view taken along line B-B of the low-stage compressor 21 according to the first embodiment.
Figure 5:
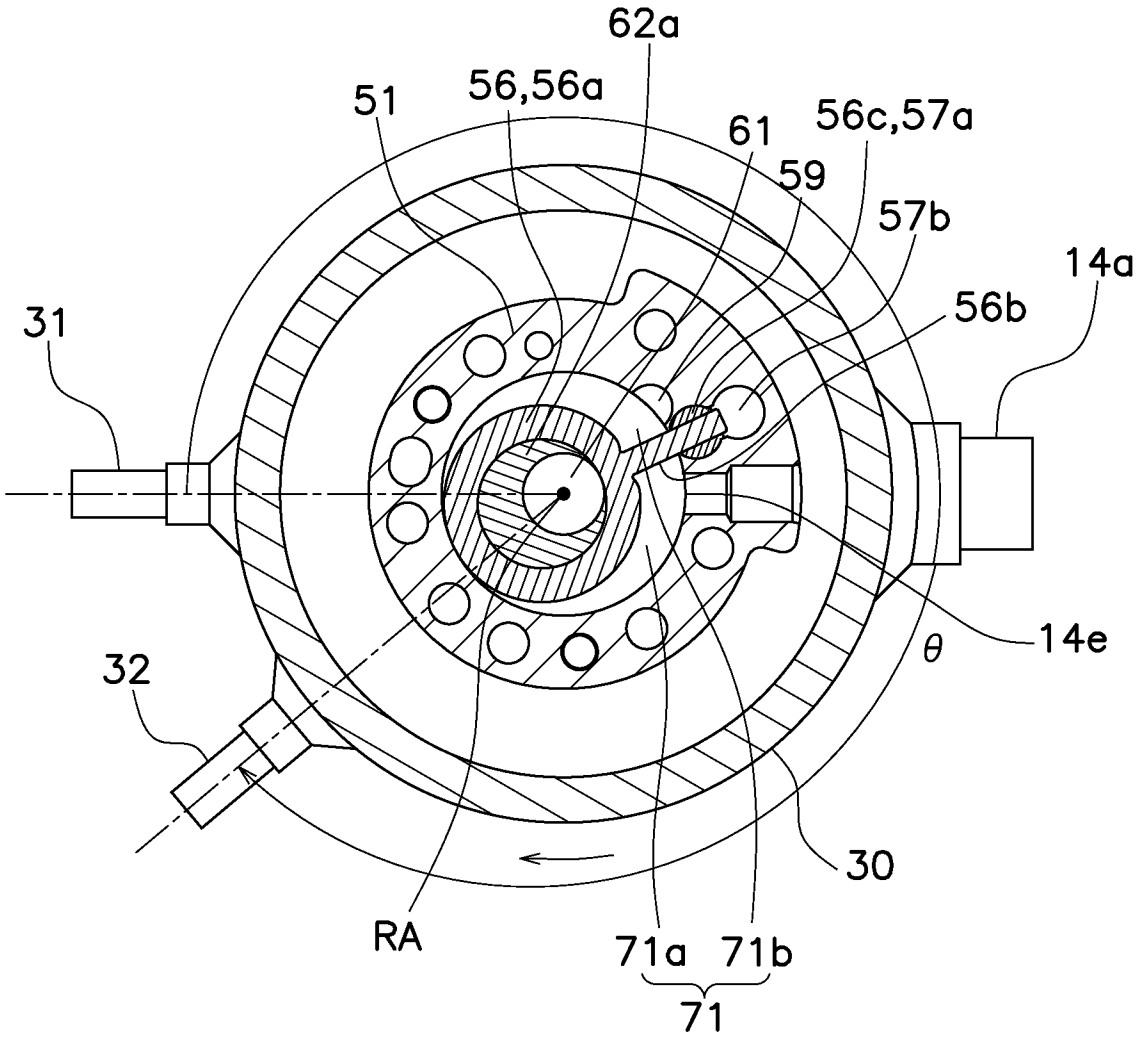
FIG. 5 is a sectional view taken along line C-C of the low-stage compressor 21 according to the first embodiment.

FIG. 2 is a vertical sectional view of the low-stage compressor 21, and FIGS. 3 to 5 are horizontal sectional views taken along lines A-A to C-C in FIG. 2, respectively. However, in the B-B sectional view in FIG. 4, a motor 40 is not shown.

The low-stage compressor 21 has a container 30, a compression part 50, the motor 40, a crankshaft 60, and a terminal 35.

(2-1) Container 30

The container 30 has a substantially cylindrical shape with an axis RA of the motor 40 as a center axis. The inside of the container is kept airtight, and an intermediate pressure is maintained in the low-stage compressor 21 and a high pressure is maintained in the high-stage compressor 23 during an operation. A lower part of the inside of the container 30 is the oil reservoir (not shown) for storing oil (lubricating oil).

The container 30 houses the motor 40, the crankshaft 60, and the compression part 50 inside. The terminal 35 is located above the container 30. Further, the container 30 is connected to suction pipes 14*a* and 14*b* and the discharge pipe 15*a* of the refrigerant, the oil return pipe 31, and the oil discharge pipe 32.

(2-2) Motor 40

The motor 40 is a brushless DC motor. The motor 40 generates power to rotate the crankshaft 60 around the axis RA. The motor 40 is disposed in a space inside the container 30, below an upper space, and above the compression part 50. The motor 40 has a stator 41 and a rotor 42. The stator 41 is fixed to an inner wall of the container 30. The rotor 42 rotates by magnetically interacting with the stator 41.

The stator 41 has a stator core 46 and insulators 47. The stator core 46 is made of steel. The insulator 47 is made of resin. The insulators 47 are disposed above and below the stator core 46, and wires are wound around the insulators 47.

(2-3) Crankshaft 60

The crankshaft 60 transmits power of the motor 40 to the compression part 50. The crankshaft 60 has a main shaft 61, a first eccentric part 62*a*, and a second eccentric part 62*b*.

The main shaft 61 is a part concentric with the axis RA. The main shaft 61 is fixed to the rotor 42.

The first eccentric part 62*a* and the second eccentric part 62*b* are eccentric with respect to the axis RA. A shape of the first eccentric part 62*a* and a shape of the second eccentric part 62*b* are symmetrical with respect to the axis RA.

An oil tube 69 is provided at a lower end of the crankshaft 60. The oil tube 69 pumps oil (lubricating oil) from the oil reservoir. The pumped lubricating oil rises in an oil passage inside the crankshaft 60 and is supplied to a sliding part of the compression part 50.

(2-4) Compression Part 50

The compression part 50 is a two-cylinder compression mechanism. The compression part 50 has a first cylinder 51, a first piston 56, a second cylinder 52, a second piston 66, a front head 53, a middle plate 54, a rear head 55, and front mufflers 58*a* and 58*b*.

A first compression chamber 71 and a second compression chamber 72 are formed in the compression part 50. The first and second compression chambers are spaces to which the refrigerant is supplied and compressed.

(2-4-1) First Compression Chamber 71 and Flow of Refrigerant Compressed in First Compression Chamber 71

As shown in FIG. 2 or 5, the first compression chamber 71 is a space surrounded by the first cylinder 51, the first piston 56, the front head 53, and the middle plate 54.

As shown in FIG. 5, the first cylinder 51 is provided with a suction hole 14*e*, a discharge concave portion 59, a bush housing hole 57*a*, and a blade moving hole 57*b*. The first cylinder 51 houses the main shaft 61 and the first eccentric part 62*a* of the crankshaft 60 and the first piston 56. The suction hole 14*e* communicates the first compression chamber 71 with the inside of the suction pipe 14*a*. A pair of bushes 56*c* is housed in the bush housing hole 57*a*.

The first piston 56 has an annular part 56*a* and a blade 56*b*. The first piston 56 is a swing piston. The first eccentric part 62*a* of the crankshaft 60 is fitted into the annular part 56*a*. The blade 56*b* is sandwiched between the pair of bushes 56*c*. The first piston 56 divides the first compression chamber 71 into two. One of the divided chambers is a low pressure chamber 71*a* that communicates with the suction hole 14*e*. The other divided chamber is a high pressure chamber 71*b* that communicates with the discharge concave portion 59. In FIG. 5, the annular part 56*a* revolves clockwise, a volume of the high pressure chamber 71*b* becomes small, and the refrigerant in the high pressure chamber 71*b* is compressed. When the annular part 56*a* revolves, a tip of the blade 56*b* reciprocates between the blade moving hole 57*b* and the bush housing hole 57*a*.

As shown in FIG. 2, the front head 53 is fixed to an inner side of the container 30 by an annular member 53*a*.

The front mufflers 58*a* and 58*b* are fixed to the front head 53. The front mufflers reduce noise when the refrigerant is discharged.

The refrigerant compressed in the first compression chamber 71 is discharged to a first front muffler space 58*e* between the front muffler 58*a* and the front head 53 via the discharge concave portion 59. After further moving to a second front muffler space 58*f* between the two front mufflers 58*a* and 58*b*, the refrigerant is blown out to a space below the motor 40 from discharge holes 58*c* and 58*d* (see FIG. 4) provided in the front muffler 58*b*.

The refrigerant that has been compressed and blown out from the discharge holes 58*c* and 58*d* of the front muffler 58*a* moves to an upper space of the container 30 through a gap of the motor 40, is blown out from the discharge pipe 15*a*, and proceeds to the high-stage compressor 23.

(2-4-2) Second Compression Chamber 72 and Flow of Refrigerant Compressed in Second Compression Chamber 72

The second compression chamber 72 is a space surrounded by the second cylinder 52, the second piston 66, the rear head 55, and the middle plate 54.

The flow of the refrigerant compressed in the second compression chamber 72, which is almost similar to the flow of the refrigerant compressed in the first compression chamber 71, will not be described in detail. However, the refrigerant compressed in the second compression chamber 72 is different in that the refrigerant is once sent to a rear muffler space 55*a* provided in the rear head 55, and then further sent to the front muffler spaces 58*e* and 58*f* by the front mufflers 58*a* and 58*b*.

(2-5) Connection Position of Compressor with Oil Return Pipe 31 and Oil Discharge Pipe 32

As shown in FIG. 2, the oil return pipe 31 is connected to the container 30 such that an internal flow path communicates with the space above the compression part 50 below the motor 40. A position below the motor 40 includes a space beside the motor 40 (core cut or the like). However, the space below the motor 40 and above the compression part 50 is more preferred. The oil return pipe 31 is connected to the container 30 so as to be substantially perpendicular to a side surface of the container 30 and to let the oil flow substantially horizontally. The oil return pipe 31 is disposed such that an angle of an oil introduction part of the oil return pipe 31 into the container 30 is within 15° above and below a horizontal.

The oil blown out of the oil return pipe 31 into the container 30 collides with the insulator 47 of the motor 40 and then falls on the front muffler 58*b* and the annular member 53*a* fixing the front head 53, and further, merges into the oil reservoir 30*a* at the lower part of the inside of the container 30. In other words, the insulator 47 serves as an oil guide that allows the oil flowing through the oil return pipe 31 and introduced into the container 30 to collide and directs the oil toward the oil reservoir 30*a* at the lower part of the container 30. The oil guide of the insulator 47 is a plate-shaped member extending vertically. All of the oil blown out from the oil return pipe 31 into the container 30 does not have to collide with the oil guide. A part of the oil blown out may collide with the oil guide. All of the oil blown out may collide with the oil guide.

The oil guide is disposed in the container 30 so as to face an outlet of the oil return pipe 31. The outlet of the oil return pipe 31 refers to a connection part between the container 30 and the oil return pipe 31 inside the container 30. The oil guide is disposed within 25% of an inner diameter D of a horizontal cross section of the container 30 from an inner circumference of the container 30. Arranging the oil guide relatively close to the side wall of the container 30 achieves good controllability of a direction of the oil.

The oil return pipe 31 is preferably connected to a space above the second compression chamber 72. If the oil return pipe 31 is connected to a space below the second compression chamber 72, there is a high possibility that an oil level will be below an oil level of the oil reservoir 30*a*, thereby causing foaming which is not preferable.

Further, the oil return pipe 31 may be connected to above the container 30. For example, the oil return pipe 31 may be connected to a core cut part of the stator 41 of the motor 40. However, the oil return pipe 31 is preferably connected to a lower part as close as possible to the oil reservoir 30*a*, allowing the oil to be supplied to a sliding part (near the compression chambers 71 and 72) more quickly.

An inner diameter of the oil return pipe 31 is, for example, 10 mm or more and 12 mm or less.

As shown in FIG. 2, the oil discharge pipe 32 is connected to the container 30 such that the internal flow path communicates with the space above the compression part 50 below the motor 40.

If the connection position of the oil discharge pipe 32 to the container 30 is below the compression chamber 72, the oil may be lost excessively from the oil reservoir 30*a*. If the connection position is above the motor 40, a difference between the oil discharge pipe 32 and the discharge pipe 15*a* will be small, and meaning of providing the oil discharge pipe 32 will be lost.

Further, in the present embodiment, as shown in FIG. 2, an attachment height position of the oil discharge pipe 32 with the container 30 is equivalent to an attachment height position of the oil return pipe 31 with the container 30. This facilitates adjustment of the oil level of the oil reservoir 30*a*.

Further, as shown in FIG. 4, the attachment position of the oil discharge pipe 32 to the container 30 having a flat shape is a position opposite to the discharge holes 58*c* and 58*d* of the front muffler 58*b* with respect to the axis RA of the motor 40. Here, the opposite position refers to a range of 180° other than a total of 180°, which is 90° to left and right of the axis RA from the connection position of the oil discharge pipe 32. Here, this means that half or more of an area of the discharge holes 58*c* and 58*d* is on the opposite side although a part of the discharge hole 58*c* is not in the opposite position in FIG. 4.

In the present embodiment, the connection position of the oil discharge pipe 32 to the container 30 is separated from positions of the discharge holes 58*c* and 58*d* of the front muffler 58*b*. This can reduce the refrigerant discharged from the discharge holes 58*c* and 58*d* of the front muffler 58*b* to be discharged from the low-stage compressor 21 directly by the oil discharge pipe 32.

An inner diameter of the oil discharge pipe 32 is equivalent to the inner diameter of the oil return pipe 31. The oil discharge pipe 32 having a smaller inner diameter than the discharge pipe 15*a* is used. Specifically, the inner diameter of the oil discharge pipe 32 is, for example, 10 mm or more and 12 mm or less.

Further, as shown in FIG. 5, in a planar positional relationship between the oil discharge pipe 32 and the oil return pipe 31, the connection position of the oil discharge pipe 32 to the container 30 is separated from the connection position of the oil return pipe 31 to the container 30 by 90° or more in a rotation direction of the motor 40 (a direction of an arrow in FIG. 5). The connection position is preferably a position separated by 180° or more. In the present embodiment, this angle is represented by θ. Theta is 270° or more. Also, θ is to be 330° or less.

In the present embodiment, the positions of the oil discharge pipe 32 and the oil return pipe 31 are sufficiently separated, and this reduces the oil introduced into the container 30 of the low-stage compressor 21 by the oil return pipe 31 to be discharged outside the container 30 directly by the oil discharge pipe 32, thereby easily equalizing the oil in the low-stage compressor 21.

In the multistage compression system 20 according to the first embodiment, the connection position of the oil return pipe 31 to the container 30 is as high as the connection position of the oil discharge pipe 32 to the container 30. The connection position of the oil return pipe 31 to the container 30 may be higher than the connection position of the oil discharge pipe 32 to the container 30.

(2-6) Accumulator 22

In the multistage compression system 20 according to the present embodiment, the first accumulator 22 is disposed upstream of the low-stage compressor 21 and the second accumulator 24 is disposed upstream of the high-stage compressor 23. The accumulators 22 and 24 once store the flowing refrigerant, prevent the liquid refrigerant from flowing to the compressor, and prevent liquid compression of the compressor. Configurations of the first accumulator 22 and the second accumulator 24 are almost the same, and thus the first accumulator 22 will be described with reference to FIG. 2.

The low-pressure gas refrigerant heated by the evaporator flows through the refrigerant pipe 13 via the four-way switching valve 5 and is introduced into the accumulator 22. The gas refrigerant is introduced into the first and second compression chambers 71 and 72 from the suction pipes 14*a* and 14*b* of the compressor 21. The liquid refrigerant and the oil accumulate at a lower part inside the accumulator. Small holes 14*c* and 14*d* are formed in the suction pipes 14*a* and 14*b* at a lower part inside the accumulator. Diameters of the holes 14*c* and 14*d* are, for example, from 1 mm to 2 mm. The oil, together with the liquid refrigerant, merges with the gas refrigerant little by little through the holes 14*c* and 14*d* and is sent to the compression chamber.

(3) Method of Manufacturing Multistage Compression System 20

In the multistage compression system 20 according to the present embodiment, a method of assembling the low-stage compressor 21 and its surroundings, which is peculiar to the present embodiment, will be briefly described.

Conventionally, a shrink fitting method is used for incorporating a motor into a compressor. However, in the present embodiment, it is necessary to make a hole in the container and weld a seat to the container in advance in order to connect the oil return pipe and the like to the container. When a seat is formed on the container, the container is distorted from a perfect circle, thereby making it difficult to incorporate the motor by the shrink fitting method. Thus, in the present embodiment, the assembly is performed by using a welding method as follows.

First, an upper lid of a cylindrical part of the container is combined and welded.

Next, a seat for connecting the oil return pipe 31 and the like to the container is formed in the container.

Next, the motor 40 is inserted from under the container and fixed to the container by the welding method. Here, as the welding method, a tag (TAG) welding method is used. Here, the tag welding method refers to a method of performing spot welding at several points (for tag welding of the container and the motor, see Japanese Patent No. 5375534, for example).

The compression part 50 is inserted into the container and fixed to the container. A fixing method is the tag welding as in the case of the motor.

A pipe such as the oil return pipe 31 is fixed to the seat formed on the container.

In this way, by using the tag welding, it is possible to fix the motor or the like to the container relatively easily even if roundness of the container is distorted due to formation of the seat of the oil return pipe 31 and the like.

(4) Characteristics (4-1)

The multistage compression system 20 according to the present embodiment is a system having the low-stage compressor 21 and the high-stage compressor 23. The system also has the oil return pipe 31 that returns the oil discharged by the high-stage compressor to the low-stage compressor 21. The oil return pipe 31 is connected to a space below the motor 40 inside the container 30.

When the oil return pipe 31 is connected to the suction pipe of the low-stage compressor as conventionally, high-temperature and high-pressure oil are mixed with the low-pressure refrigerant, and a heat loss and a pressure loss occur. In the multistage compression system 20 according to the present embodiment, the oil return pipe 31 is connected to the space below the motor 40 inside the container 30, and such losses can be reduced.

Further, conventionally, Patent Literature 1 proposes a configuration in which the oil return pipe 31 is connected to the suction pipe (refrigerant pipe 13) of the first accumulator 22. When passing through the first accumulator 22, the oil passes through the small holes 14*c* and 14*d* of the suction pipes 14*a* and 14*b* of the compressor 21. It therefore takes time to reach the compression chamber. In contrast, in the present embodiment, the oil return pipe 31 is connected to a space below the motor 40 inside the container 30. Therefore, the oil can be supplied to near the compression part 50 faster than conventionally.

(4-2)

In the multistage compression system 20 according to the present embodiment, the oil return pipe 31 is connected to above the compression chamber 72 in the container 30.

In the multistage compression system 20 according to the second aspect, the oil return pipe 31 is connected to a position above the compression chamber 72 of the container 30. This increases a possibility of supplying the oil to above the oil reservoir of the low-stage compressor 21, and a problem of supplying the oil below a liquid level or, in other words, a problem of foaming is likely to be avoided.

(4-3)

The multistage compression system 20 according to the present embodiment further includes the first accumulator 22 and the suction pipes 14*a* and 14*b*. The first accumulator 22 prevents liquid compression of the low-stage compressor 21. The suction pipes 14*a* and 14*b* connect the inside of the first accumulator 22 and the compression part 50. The suction pipes 14*a* and 14*b* are provided with the oil return holes 14*c* and 14*d*. The oil return holes 14*c* and 14*d* are for gradually mixing the liquid refrigerant and the oil inside the accumulator 22 with the gas refrigerant and sending the mixture to the compression part. A flow path cross-sectional area of the oil return pipe 31 is larger than an area of the oil return holes 14*c* and 14*d*.

In the multistage compression system 20 according to the present embodiment, the flow path cross-sectional area of the oil return pipe 31 is larger than the area of the oil return holes 14*c* and 14*d*, and thus the oil return pipe 31 can supply the oil to the compression part 50 more quickly than the oil is supplied from the oil return holes 14*c* and 14*d*.

(4-4)

The multistage compression system 20 according to the present embodiment further includes the oil cooler 27 in a middle of the oil return pipe 31.

The multistage compression system 20 according to the present embodiment further includes the oil cooler 27, and thus the cooled oil can be returned to the low-stage compressor by the oil return pipe, and an energy loss can be reduced.

(4-5)

The multistage compression system 20 according to the present embodiment further includes the decompressor 31*a*. The decompressor 31*a* is disposed in a middle of the oil return pipe 31.

The multistage compression system 20 according to the present embodiment can decompress the high-pressure oil discharged by the high-stage compressor 23 by the decompressor 31*a* and return the oil to the low-stage compressor, thereby reducing the energy loss.

(4-6)

In the multistage compression system 20 according to the present embodiment, the refrigerant is a refrigerant mainly including carbon dioxide, and the oil is oil incompatible with carbon dioxide. Examples of oil incompatible with carbon dioxide are polyalkylene glycols (PAG) and polyester esters (POE).

In such a mixed solution of incompatible oil and carbon dioxide refrigerant, when the refrigeration apparatus 1 is operated under normal temperature conditions (−20° C. or higher), the oil is in a lower part and the refrigerant is in an upper part due to a specific gravity.

This makes it easy to separate the oil in the oil separator and return only the oil to the low-stage compressor 21.

(4-7)

The multistage compression system 20 according to the present embodiment has the low-stage compressor 21, the high-stage compressor 23, and the oil return pipe 31. The oil return pipe 31 returns the oil discharged from the high-stage compressor to the low-stage compressor 21. The low-stage compressor 21 includes the compression part 50, the motor 40, the container 30, and the oil guide. The container houses the compression part 50, the motor 40, and the oil guide. The oil guide is disposed in the container 30 so as to face an outlet of the oil return pipe 31. The oil guide allows the oil flowing through the oil return pipe 31 and introduced into the container 30 to collide and directs the oil toward the oil reservoir 30*a* at the lower part of the container 30.

In the present embodiment, the insulator 47 as a part of the motor 40 serves as the oil guide.

The multistage compression system 20 according to the present embodiment, which has the oil guide, can supply the oil more directly to the oil reservoir 30*a*. This can increase an amount of oil in the low-stage compressor 21 quickly.

On the other hand, if the connection position of the oil return pipe 31 to the container 30 is set to a position lower than the liquid level of the oil reservoir 30*a*, such as under the compression part 50, a foaming phenomenon may occur, which is not preferable.

Further, the oil is directly supplied to the oil reservoir, and this can increase the amount of oil more quickly than conventionally when the oil is supplied to the suction pipe. Further, as compared with a case where high-temperature and high-pressure oil is mixed with the sucked refrigerant to the compressor, the pressure and temperature losses can be reduced because the oil is directly supplied to the oil reservoir.

(4-8)

In the multistage compression system 20 according to the present embodiment, the oil return pipe is disposed such that the angle of the oil introduction part of the oil return pipe into the container is within 15° above and below the horizontal.

In the multistage compression system 20 according to the present embodiment, the angle of the oil introduction part of the oil return pipe into the container is close to the horizontal, and this makes it easy to allow the oil to collide with the oil guide, change the direction of the oil, and supply the oil to the oil reservoir.

(4-9)

In the multistage compression system 20 according to the present embodiment, the oil guide is disposed within 25% of the inner diameter D of the horizontal cross section of the container 30 from the inner circumference of the container 30.

In the multistage compression system 20 according to the present embodiment, the oil guide is disposed near the inner surface of the container, and this allows the oil introduced from the oil return pipe 31 to collide with the oil guide in a short distance, and the direction of the oil to be controlled easily.

(5) Modifications (5-1) Modification 1A

In the multistage compression system 20 according to the first embodiment, the connection position of the oil return pipe 31 to the container 30 is as high as the connection position of the oil discharge pipe 32 to the container 30. In the multistage compression system 20 of Modification 1A, the connection position of the oil return pipe 31 to the container 30 is higher than the connection position of the oil discharge pipe 32 to the container 30. The other configurations are the same as those in the first embodiment.

In the multistage compression system 20 of Modification 1A, the oil level in the oil reservoir of the low-stage compressor 21 is suppressed to be lower than that of the multistage compression system 20 according to the first embodiment. The amount of the oil in the low-stage compressor 21 is smaller than that in the first embodiment and is appropriately controlled.

(5-2) Modification 1B

In the multistage compression system 20 according to the first embodiment, the compressors 21 and 23 are both two-cylinder compressors. In the multistage compression system 20 of Modification 1B, the compressors 21 and 23 are both one-cylinder compressors. The other configurations are the same as those in the first embodiment.

The multistage compression system 20 of Modification 1A also has similar characteristics (4-1) to (4-6) to the multistage compression system 20 according to the first embodiment.

Further, when one of the low-stage compressor 21 or the high-stage compressor 23 is one-cylinder type and the other one is two-cylinder type, similar characteristics to those of the first embodiment are obtained.

(5-3) Modification 1C

In the first embodiment, the oil return pipe 31 returns the oil from the oil separator 25 to the low-stage compressor 21. In Modification 1C the oil return pipe 31 directly returns the oil discharged from the high-stage compressor 23 to the low-stage compressor 21. The other configurations are similar to those in the first embodiment.

The multistage compression system 20 of Modification 1C also has similar characteristics (4-1) to (4-6) to the multistage compression system 20 according to the first embodiment. However, in Modification 1A, the excess refrigerant and oil discharged from the high-stage compressor 23 are mixed, and thus the amount of refrigerant mixed in the oil flowing through the oil return pipe 31 is increased as compared with a case where the refrigerant passes through the oil separator 25 in the first embodiment.

Further, the oil separated from the oil separator 25 may be added to the oil discharged from the high-stage compressor 23 and returned to the container 30 of the low-stage compressor 21.

(5-4) Modification 1D

In addition to the configuration of the multistage compression system 20 according to the first embodiment, the multistage compression system of Modification 1D further includes a liquid level gauge measuring the amount of the oil in the oil reservoir of the low-stage compressor 21 and a control valve provided in the middle of the oil return pipe 31 and controlling a flow rate of the oil flowing through the oil return pipe 31. Then, based on liquid level data measured by the liquid level gauge, control is performed such that the flow rate of the control valve is decreased when the liquid level is higher than a predetermined value, and the flow rate of the control valve is increased when the liquid level is lower than a predetermined value.

The multistage compression system of Modification 1D includes the liquid level gauge and the control valve, and can perform feedback control of the oil amount of the low-stage compressor 21 using the oil return pipe 31. The multistage compression system 20 of Modification 1D also has similar characteristics (4-1) to (4-6) to the multistage compression system 20 according to the first embodiment.

(5-5) Modification 1E

The multistage compression system 20 according to the first embodiment has a two-stage compression system of the low-stage compressor 21 and the high-stage compressor 23. The multistage compression system of Modification 1E is a four-stage compression system having four compressors. In Modification 1E, the compressor on a lowest stage corresponds to the low-stage compressor 21 according to the first embodiment, the compressor on a highest stage corresponds to the high-stage compressor 23 according to the first embodiment, and the discharge pipes of the three compressors on a low stage correspond to the intermediate pressure refrigerant pipe 15 according to the first embodiment.

The multistage compression system 20 of Modification 1E also has similar characteristics (4-1) to (4-6) to the multistage compression system 20 according to the first embodiment.

The multistage compression system 20 of Modification 1E is a multistage compression system in which four compressors are connected in four stages. The present disclosure is also effective when a multistage compression system in which three compressors are connected in three stages, and when a multistage compression system in which five or more compressors are connected in five or more stages.

(5-6) Modification 1F

The multistage compression system 20 according to the first embodiment includes the intercooler 26 upstream of the intermediate pressure refrigerant pipe 15 connected to the discharge pipe 15*a* of the low-stage compressor 21 and the merging part 15*b* of the intermediate injection downstream of the intermediate injection pipe 15. The multistage compression system 20 of Modification 1F includes the merging part 15*b* of the intermediate injection upstream of the intermediate pressure refrigerant pipe 15 and the intercooler 26 downstream of the intermediate pressure refrigerant pipe 15. The other configurations are the same as those in the first embodiment.

The multistage compression system 20 of Modification 1F also has similar characteristics (4-1) to (4-6) to the multistage compression system 20 according to the first embodiment.

(5-7) Modification 1G

The multistage compression system 20 according to the first embodiment includes the intercooler 26 upstream of the intermediate pressure refrigerant pipe 15 connected to the discharge pipe 15*a* of the low-stage compressor 21 and the merging part 15*b* of the intermediate injection downstream of the intermediate injection pipe 15. In the multistage compression system 20 of Modification 1G, only the intercooler 26 is provided in the intermediate pressure refrigerant pipe 15, and the merging part 15*b* of the intermediate injection passage is not provided. Modification 1G does not include the economizer heat exchanger 7. The other configurations are similar to those in the first embodiment.

The multistage compression system 20 of Modification 1G also has similar characteristics (4-1) to (4-6) to the multistage compression system 20 according to the first embodiment.

Further, contrary to Modification 1G, the present disclosure is also effective when the multistage compression system 20 only includes the intermediate injection merging part 15*b* in the intermediate pressure refrigerant pipe 15 and does not include the intercooler 26.

(5-8) Modification 1H

In the multistage compression system 20 according to the first embodiment, the oil discharge pipe 32 is connected to downstream of the merging part 15*b* of the intermediate injection on the intermediate pressure refrigerant pipe 15. In Modification 1H, the oil discharge pipe 32 is connected upstream of the intercooler 26 on the intermediate pressure refrigerant pipe 15. At the merging part, a pressure difference between the oil discharge pipe 32 and the intermediate pressure refrigerant pipe 15 is smaller in Modification 1H than in the first embodiment. Therefore, the oil discharge amount is smaller in Modification 1H than in the first embodiment. Consequently, the amount of oil in the low-stage compressor is controlled to be larger in Modification 1H than in the first embodiment. The other configurations and characteristics are similar to those in the first embodiment.

Further, the oil discharge pipe 32 may be connected between the intercooler 26 and the merging part 15*b* of the intermediate injection on the intermediate pressure refrigerant pipe 15, or in a middle of the intercooler 26. The oil discharge amount of the oil discharge pipe 32 changes depending on the connection position on the intermediate pressure refrigerant pipe 15, but in that case, the other configurations and characteristics are also similar to those in the first embodiment.

(5-9) Modification 1I

In the multistage compression system 20 according to the first embodiment, the rotary compression part of the compressor 21 has the first piston 56 in which the annular part 56*a* and the blade 56*b* are integrated. The rotary compressor of Modification 1I has a vane instead of the blade, and the vane and the piston are separate bodies. The other configurations are similar to those in the first embodiment.

The multistage compression system 20 of Modification 1I also has similar characteristics (4-1) to (4-6) to the multistage compression system 20 according to the first embodiment.

(5-10) Modification 1J

In the multistage compression system 20 according to the first embodiment, the receiver 6 and the economizer heat exchanger 7 are disposed upstream of the intermediate injection pipe. In the multistage compression system 20 of Modification 1J, only the receiver 6 is provided upstream of the intermediate injection pipe 12, and the economizer heat exchanger 7 is not provided. The other configurations are similar to those in the first embodiment.

The multistage compression system 20 of Modification 1J also has similar characteristics (4-1) to (4-6) to the multistage compression system 20 according to the first embodiment.

Further, contrary to Modification 1J, the present disclosure is also effective when the multistage compression system 20 only includes the economizer heat exchanger 7 upstream of the intermediate injection pipe 12 and does not include the receiver 6.

(5-11) Modification 1K

In the first embodiment, the oil guide changing the direction of the oil introduced into the low-stage compressor 21 from the oil return pipe 31 is the insulator 47 of the motor 40. In Modification 1K, the oil guide is an outer surface of the stator core 46 of the stator 41 of the motor 40. In Modification 1K, the oil return pipe 31 is connected to the side wall of the container 30 at a height of the stator core 46. As shown in FIG. 3, a core cut part 46*a* as a gap is formed between the container 30 and the stator core 46. In Modification 1A, the oil return pipe 31 is connected to a part of the side wall of the container 30, the part facing the core cut part 46*a*. The other configurations are the same as those in the first embodiment.

In the multistage compression system of Modification 1K, an outer surface of the stator 41 serves as an oil guide, and the oil from the oil return pipe 31 can be quickly supplied to the oil reservoir 30*a*. However, as compared with the first embodiment, a vertical distance from the oil return pipe to the oil reservoir is longer, and time for supplying the oil is slightly longer.

Figure 6:
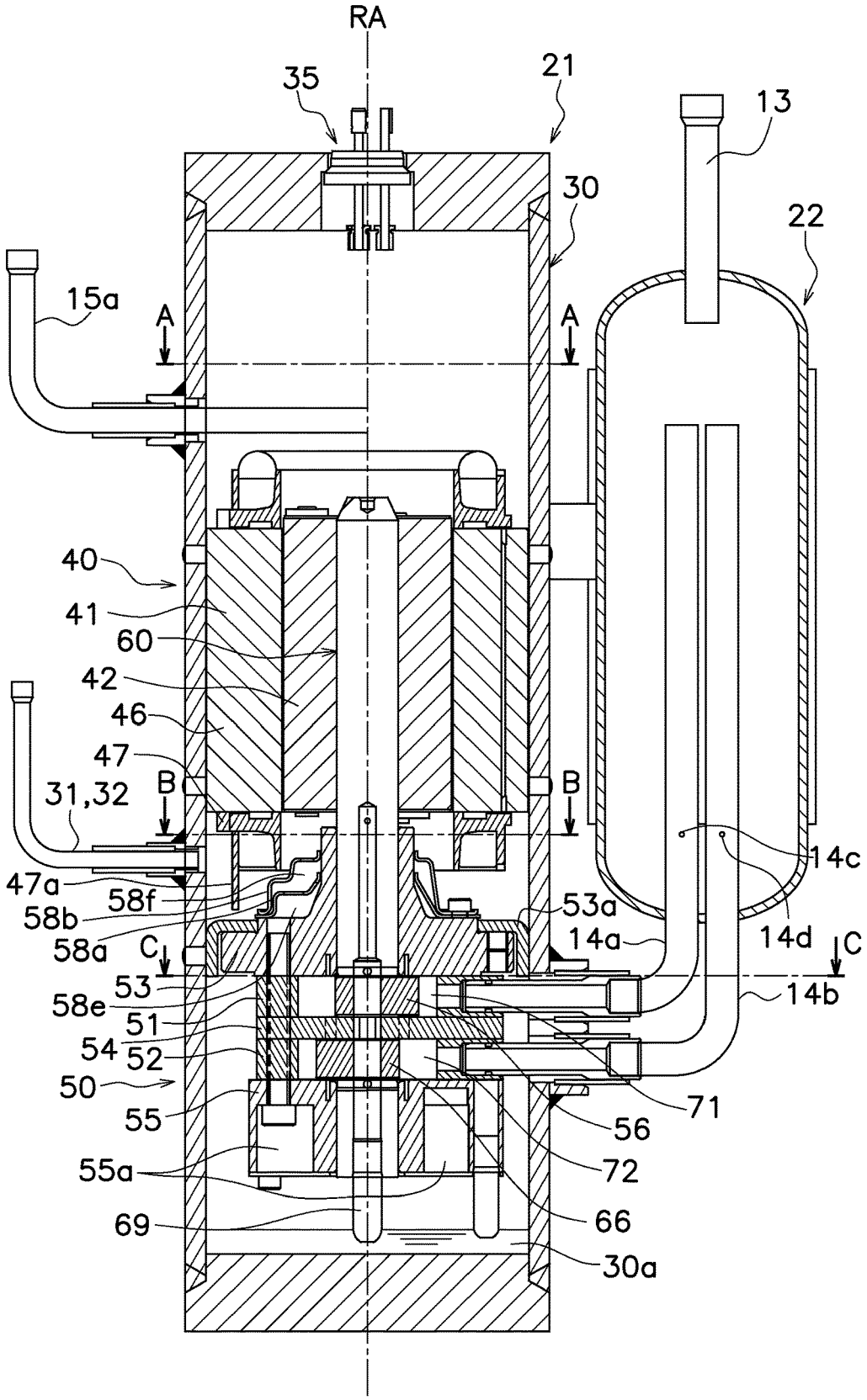
FIG. 6 is a vertical sectional view of a low-stage compressor 21 according to a second embodiment.

Second Embodiment (6) Oil Guide of Low-Stage Compressor 21 According to Second Embodiment In the first embodiment, the oil guide allows the oil flowing through the oil return pipe 31 and introduced into the container 30 to collide and directs the oil toward the oil reservoir 30*a* at the lower part of the container 30, and this oil guide is a part of the insulator 47 of the motor 40. In a second embodiment, as shown in FIG. 6, a part of the insulator is extended downward. The insulator 47 and an extension part 47*a* of this insulator serve as an oil guide. The extension part is a plate-shaped member extending vertically. The other configurations are the same as those in the first embodiment.

In the second embodiment, the extension part 47*a* in which a part of the insulator is extended functions as an oil guide as described above, and this allows more oil from the oil return pipe to collide and to be directed toward the oil reservoir.

As a modification of the second embodiment, instead of using the extension part 47*a* of the insulator, a completely different component may be disposed inside the container 30 as an oil guide. However, in this case, the number of components increases and a new oil guide has to be fixed to a path of the oil.

Figure 7:
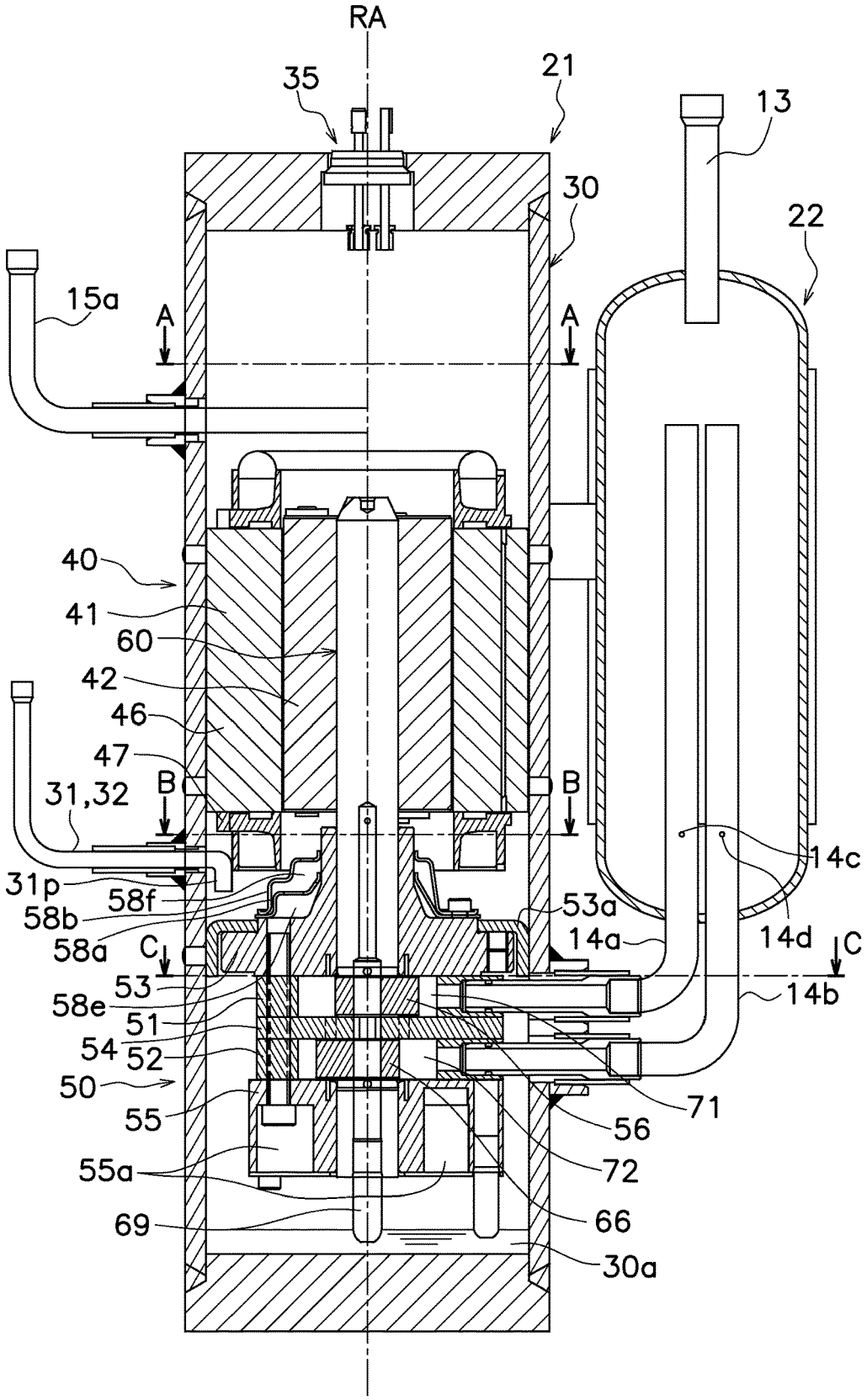
FIG. 7 is a vertical sectional view of a low-stage compressor 21 according to a third embodiment.

Third Embodiment (7) Oil Guide of Low-Stage Compressor 21 According to Third Embodiment In the first and second embodiments, the oil guide is one component of the motor 40 or an extension of one component. In a third embodiment, as shown in FIG. 7, an extension part 31*p* of the oil return pipe 31 into the container 30 serves as an oil guide. The extension part 31*p* may be integrated with the oil return pipe 31 or a separate object may be connected to the oil return pipe 31. The other configurations of the third embodiment are similar to those in the first embodiment. The oil guide according to the third embodiment also exhibits the same effect as the oil guide according to the first embodiment.

Fourth Embodiment (8) Refrigeration Apparatus 1 According to Fourth Embodiment The refrigeration apparatus 1 according to a fourth embodiment has the same configuration as the refrigerating apparatus 1 according to the first embodiment except for the configuration of the oil return pipe 31. Therefore, the description of (1) refrigerant circuit of refrigerating apparatus 1 to (3) method of manufacturing multistage compression system 20 according to the first embodiment is the same as the description of the refrigeration apparatus 1 according to the first embodiment except for "(2-5) connection position of low-stage compressor 21, oil return pipe 31, and oil discharge pipe 32". The description is omitted, and in the fourth embodiment, "connection position of low-stage compressor 21, oil return pipe 31, and oil discharge pipe 32" will be described below.

(8-1) Connection Position of Low-Stage Compressor 21, Oil Return Pipe 31, and Oil Discharge Pipe 32

Figure 8:
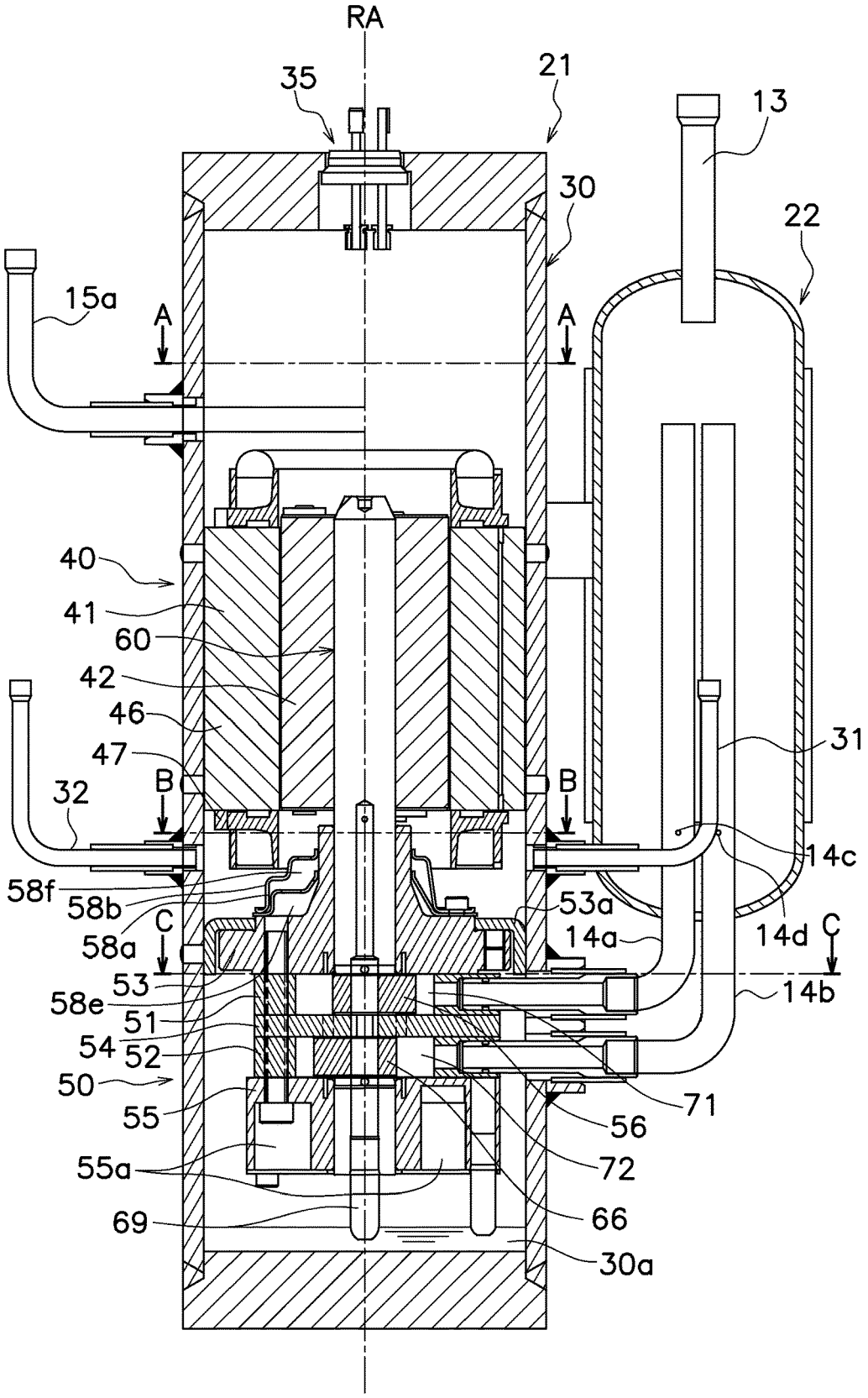
FIG. 8 is a vertical sectional view of a low-stage compressor 21 according to a fourth embodiment.
Figure 9:
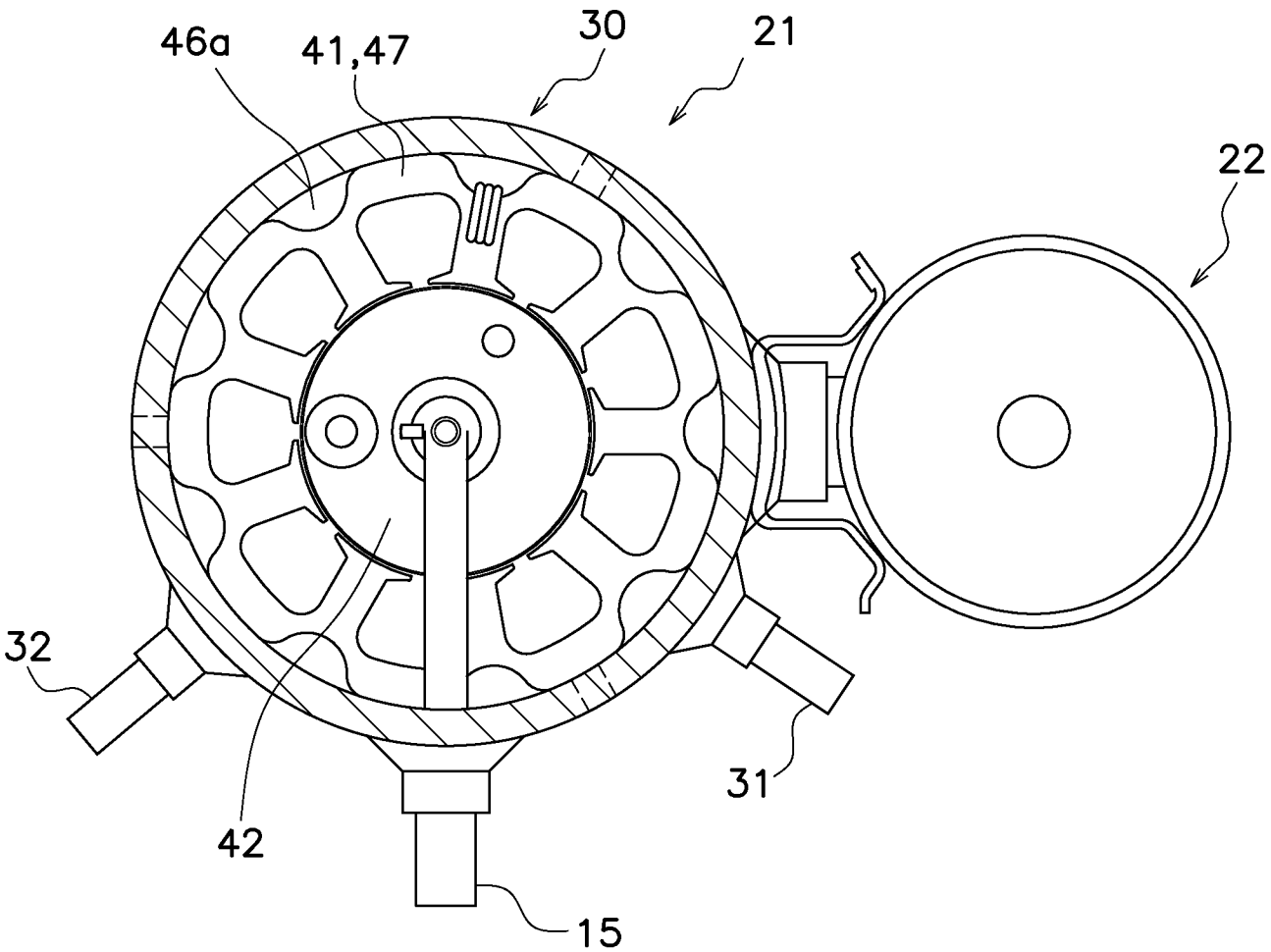
FIG. 9 is a sectional view of the low-stage compressor 21 according to the fourth embodiment taken along line AA.
Figure 10:
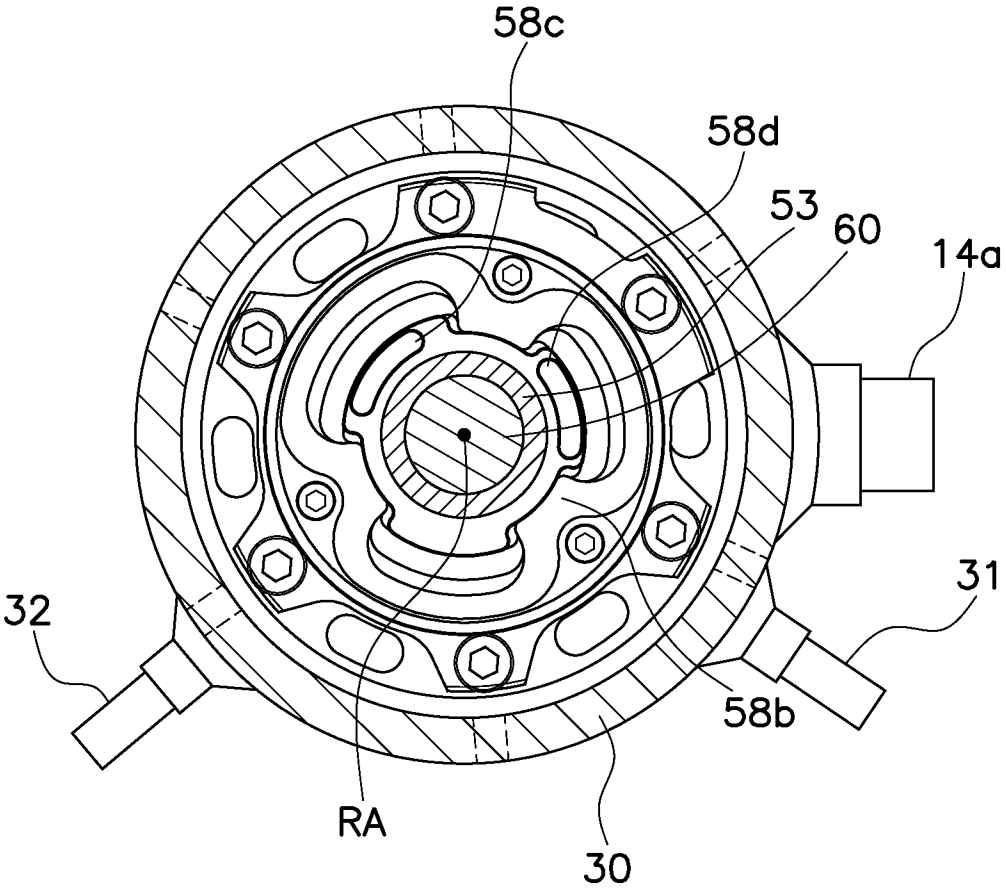
FIG. 10 is a sectional view of the low-stage compressor 21 according to the fourth embodiment taken along line BB.

In the multistage compression system 20 according to the present embodiment, as shown in FIG. 8, the oil return pipe 31 is connected to the space of the container 30 below the motor 40 and above the compression part 50.

The oil blown out of the oil return pipe 31 into the container 30 collides with the insulator 47 of the motor 40 and then falls on a member in an upper part of the compression part 50, and further, merges into the oil reservoir 30*a* at the lower part of the inside of the container 30. Here, the member above the compression part is a member that is above the cylinder 51 and is in direct or indirect contact with the cylinder 51. Specifically, the member above the compression part includes the front head 53, the front mufflers 58*a* and 58*b*, and the annular member 53*a*.

In other words, the cylinders 51 and 52 can be indirectly heated by the high-temperature oil separated by the oil separator 25.

Next, the connection position of the oil return pipe 31 to the container in a top view will be described with reference to FIG. 11.

First, the axis RA is a center. Then, a straight line passing through a center of the axis RA and the bush housing hole 57*a* is set to 0° as a reference. In other words, a direction of a center of a cutout part for housing the vane (blade 56*b*) on an inner circumference of the cylinder 51 is 0°. An angle from this reference direction to a center of a part to which the oil return pipe 31 is connected in a top view is a. In the present embodiment, a is 0° or more and 120° or less. Preferably, a is 30° or more and 90° or less.

The oil return pipe 31 according to the present embodiment is connected to the container 30 such that a is 0° or more and 120° or less, and thus the oil from the oil return pipe 31 is introduced to be applied to a range of this angle in the upper part of the compressor 50. Thus, a vicinity of the suction hole 14*e* of the cylinder 51 can be heated.

An inner diameter of the oil return pipe 31 is, for example, 10 mm or more and 12 mm or less.

Next, as shown in FIG. 8, the oil discharge pipe 32 is connected to the container 30 such that the internal flow path communicates with the space above the compression part 50 below the motor 40.

Further, in the present embodiment, as shown in FIG. 8, an attachment height position of the oil discharge pipe 32 with the container 30 is equivalent to an attachment height position of the oil return pipe 31 with the container 30. This facilitates adjustment of the oil level of the oil reservoir 30*a*.

An inner diameter of the oil discharge pipe 32 is equivalent to the inner diameter of the oil return pipe 31. The oil discharge pipe 32 having a smaller inner diameter than the discharge pipe 15*a* is used. Specifically, the inner diameter of the oil discharge pipe 32 is, for example, 10 mm or more and 12 mm or less.

Figure 11:
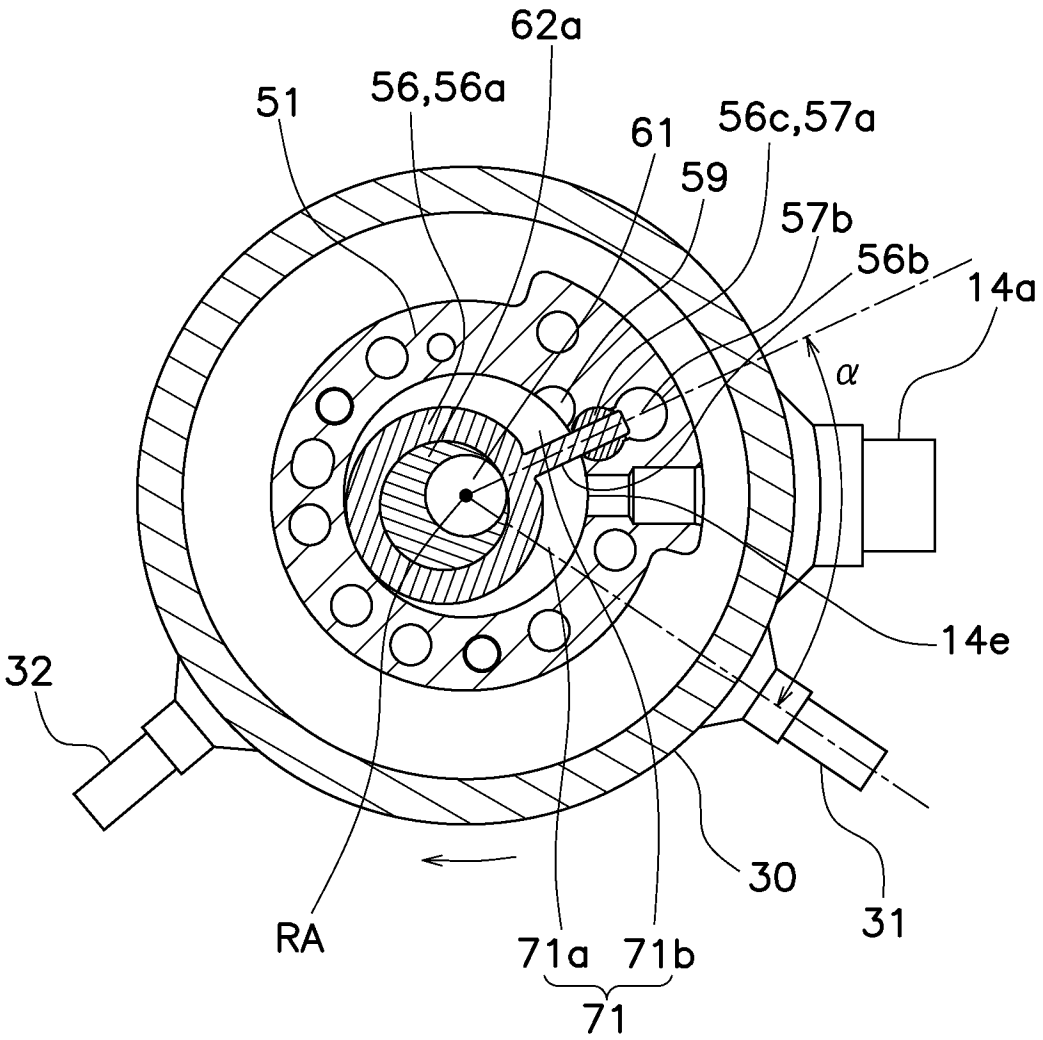
FIG. 11 is a sectional view of the low-stage compressor 21 according to the fourth embodiment taken along line CC.

Further, as shown in FIG. 11, in a planar positional relationship between the oil discharge pipe 32 and the oil return pipe 31, the connection position of the oil discharge pipe 32 to the container 30 is separated from the connection position of the oil return pipe 31 to the container 30 by 90° or more in the rotation direction of the motor 40 (a direction of an arrow in FIG. 11). The connection position is preferably a position separated by 180° or more.

In the present embodiment, the positions of the oil discharge pipe 32 and the oil return pipe 31 are sufficiently separated, and this reduces the oil introduced into the container 30 of the low-stage compressor 21 by the oil return pipe 31 to be discharged outside the container 30 directly by the oil discharge pipe 32, thereby easily equalizing the oil in the low-stage compressor 21.

In the multistage compression system 20 according to the fourth embodiment, the connection position of the oil return pipe 31 to the container 30 is as high as the connection position of the oil discharge pipe 32 to the container 30. The connection position of the oil return pipe 31 to the container 30 may be higher than the connection position of the oil discharge pipe 32 to the container 30.

(9) Characteristics of Fourth Embodiment (9-1)

The multistage compression system 20 according to the present embodiment has the low-stage compressor 21, the high-stage compressor 23, and the oil return pipe 31. The oil return pipe 31 returns the oil discharged from the high-stage compressor to the low-stage compressor 21. The low-stage compressor 21 includes the compression part 50, the motor 40, and the container 30. The container houses the compression part 50 and the motor 40. The compression part 50 has the piston and the cylinder. The cylinder houses the piston.

In the present embodiment, the oil return pipe 31 is connected to the container 30 such that the oil having flowed through the oil return pipe 31 is applied to the cylinders 51 and 52 or the member in contact with the upper and lower parts of the cylinder. Here, the member in contact with the upper and lower parts of the cylinders 51 and 52 includes a member in direct contact with the cylinders 51 and 52 and a member in contact with the members in direct contact with the cylinders 51 and 52. Specifically, the member includes the front head 53, the middle plate 54, the rear head 55, the front mufflers 58*a* and 58*b*, and the annular member 53*a*. Further, here, "the oil is applied" includes not only a case where the oil ejected from the oil return pipe 31 directly collides with these members, but also a case where the oil collides with another object once and then collides with these members. Another object is the insulator 47 in the present embodiment.

In the multistage compression system 20 according to the present embodiment, the oil having a high-temperature from the oil return pipe 31 can be applied to the cylinders 51 and 52 or the members in contact with the upper and lower parts of the cylinders, and thus the cylinders 51 and 52 having a relatively large heat capacity can be heated. As a result, a temperature difference between the pistons 56 and 66 and the cylinders 51 and 52 can be suppressed.

(9-2)

In the multistage compression system 20 according to the present embodiment, the characteristics of the attachment position of the oil return pipe 31 to the container 30 in a top view are as follows. The connection position of the oil return pipe 31 to the container 30 is within a range of 120° in the rotation direction of the motor from a rotation center of the motor, where the direction of the center of the cutout part for housing the vane on the inner circumference of the cylinder is 0°.

The multistage compression system 20 according to the present embodiment can heat the cylinder near the suction hole 14*e* of the compression chamber. This makes it possible to heat the cylinder near the piston, which is heated by the suction refrigerant, and makes it easy to eliminate the temperature difference between the cylinder and the piston.

(9-3)

In the multistage compression system 20 according to the present embodiment, the oil return pipe 31 is connected to the container 30 such that the oil having flowed through the oil return pipe 31 is applied from above to the cylinders 51 and 52 or the member in contact with the upper parts of the cylinders. Here, the member in contact with the upper parts of the cylinders include the front head 53, the front mufflers 58*a* and 58*b*, and the annular member 53*a*.

The multistage compression system 20 according to the present embodiment can heat the cylinders over a large area.

(10) Modification of Fourth Embodiment (10-1) Modification 4A

Figure 12:
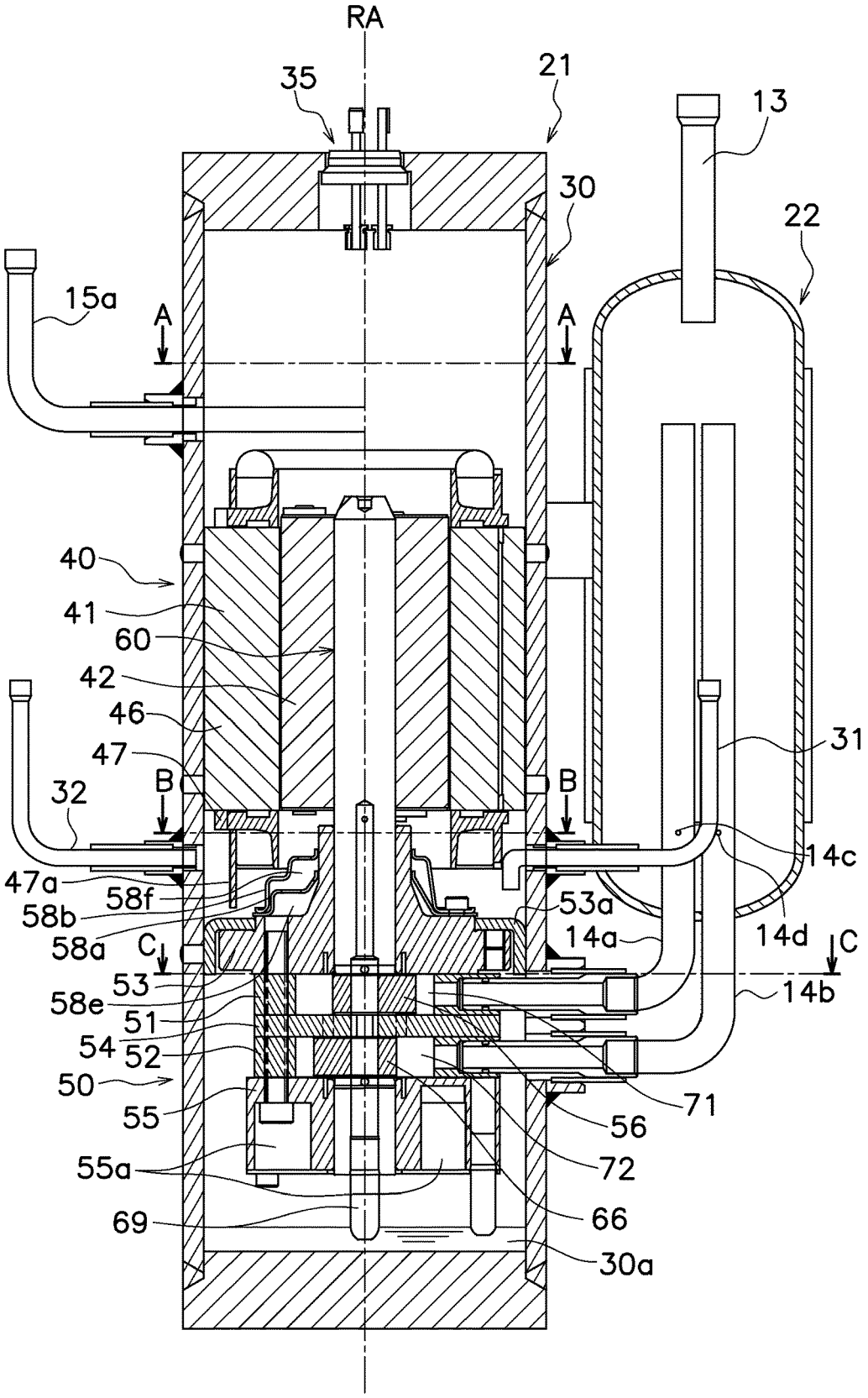
FIG. 12 is a vertical sectional view of a low-stage compressor 21 according to Modification 4A.

In the fourth embodiment, as shown in FIG. 8, the oil return pipe 31 is connected to the container 30 of the low-stage compressor 21, and the oil introduced into the container 30 falls on the front head 53, the front muffler 58*a* and 58*b*, and the annular member 53*a*, which are members above the cylinder 51 in the space inside the container. In Modification 4A, as shown in FIG. 12, the low-stage compressor 21 has a pipe 31*p* controlling the direction of the oil inside the container 30. The pipe 31*p* may be formed integrally with the oil return pipe 31, or the pipe 31*p* as a separate pipe may be connected to the oil return pipe 31 such that an oil flow path is continuous. The other configurations of Modification 4A are similar to those in the first embodiment.

In the multistage compression system of Modification 4A, the oil flow is controlled by the pipe 31*p*. Thus, the high-temperature oil from the oil return pipe 31 can be more reliably applied to the member in contact with the upper part of the cylinder, and the cylinder can be heated efficiently.

(10-2) Modification 4B

Figure 13:
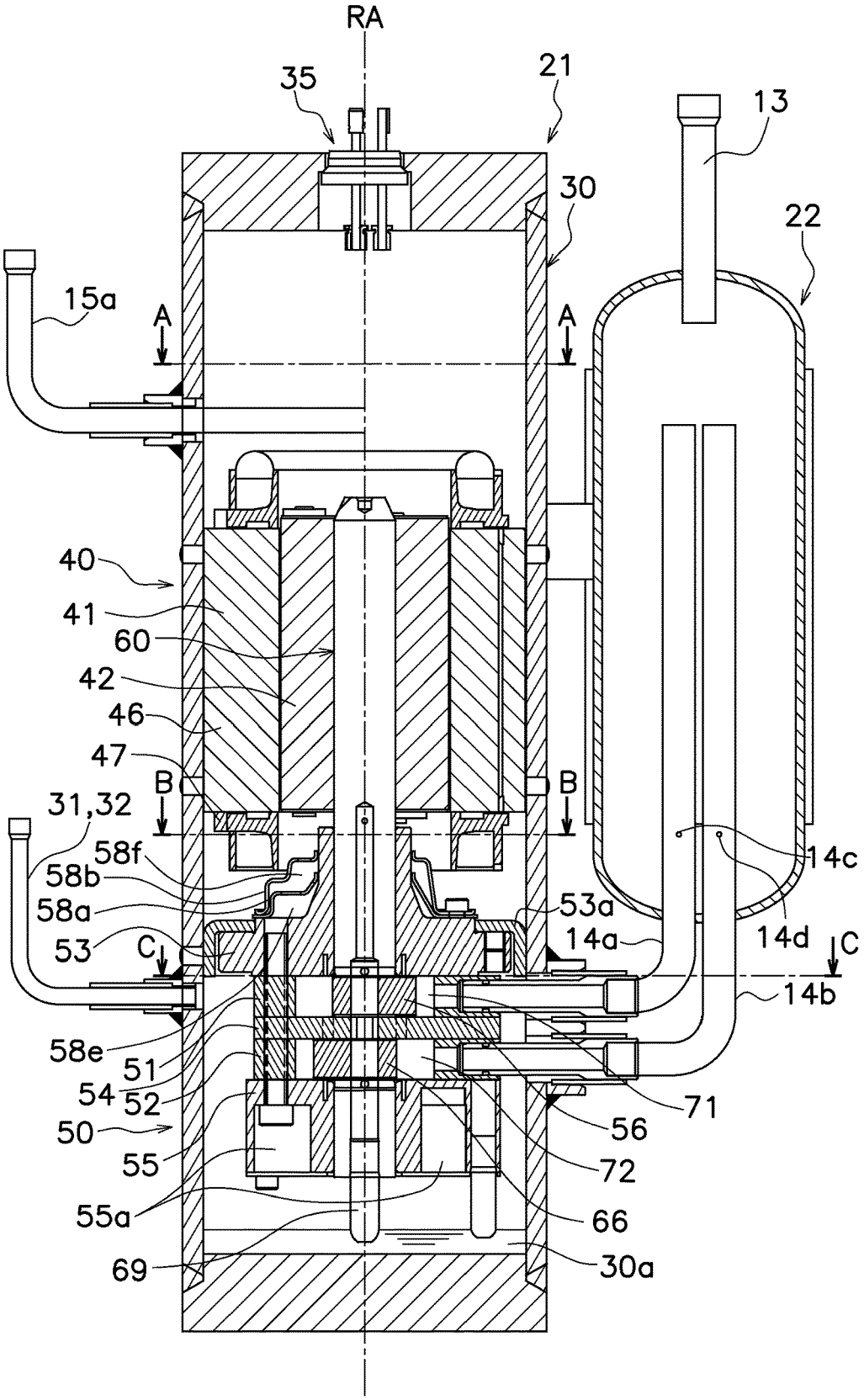
FIG. 13 is a vertical sectional view of a low-stage compressor 21 according to Modification 4B.

The multistage compression system of Modification 4B will be described with reference to the drawings. In FIG. 13, the oil return pipe 31 and the oil discharge pipe 32 are two separate pipes, but are illustrated as being overlapped to look like one pipe. The oil return pipe 31 is to be drawn on a right side surface of the container 30 in FIG. 13, but is drawn on a left side surface for space limitations.

In the multistage compression system according to the fourth embodiment and Modification 4A, the oil return pipe 31 is connected to the container 30 such that the high-temperature oil from the oil return pipe 31 is applied from above to the member in contact with the upper part of the cylinder. In other words, the connection position of the oil return pipe 31 is above the member in contact with the upper part of the cylinder. On the other hand, in Modification 4B, as shown in FIG. 13, the connection position of the oil return pipe 31 to the container 30 is as high as the cylinder 51. The other configurations are similar to those in the fourth embodiment.

In the multistage compression system 20 of the modification 4B, the side surface of the cylinder 51 can be heated with oil. The cylinder 51 can be directly heated, and the temperature of the cylinder 51 can be easily controlled.

Further, in the multistage compression system 20 of Modification 4B, the oil outlet of the oil return pipe 31 in the container 30 is provided so as to face the cylinder 51.

In the multistage compression system 20 of Modification 4B, the oil outlet of the oil return pipe 31 in the container 30 is disposed to face a vicinity of the cylinder, and this allows the high-temperature oil to collide with the vicinity of the cylinder more reliably.

(10-3) Modification 4C

Figure 14:
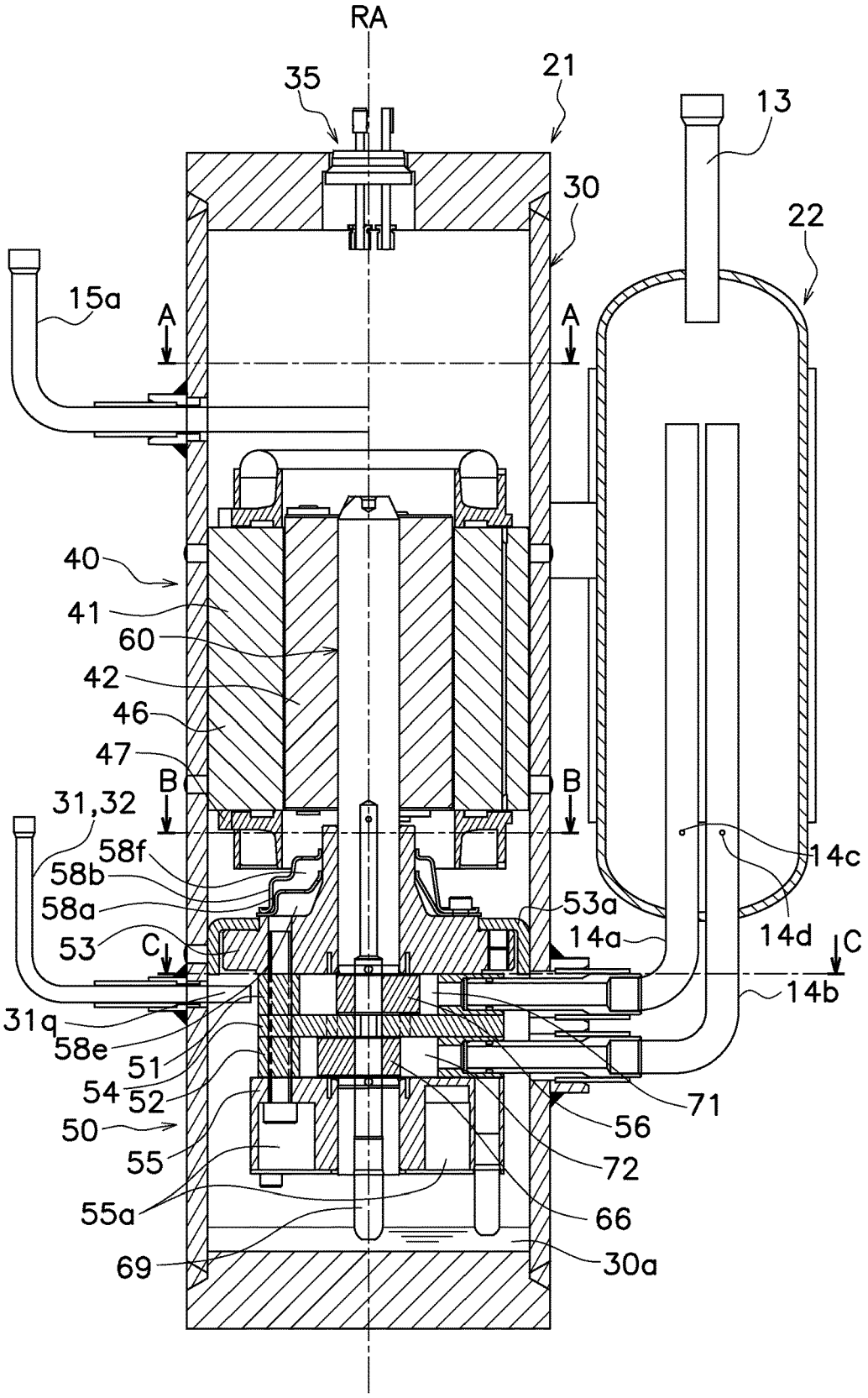
FIG. 14 is a vertical sectional view of a low-stage compressor 21 according to Modification 4C.

The multistage compression system of Modification 4C will be described with reference to the drawings. In FIG. 14, the oil return pipe 31 and the oil discharge pipe 32 are two separate pipes, but are illustrated as being overlapped to look like one pipe. The oil return pipe 31 and a pipe 31*q* extended from the oil return pipe 31 are to be illustrated on a right side surface of the container 30 in FIG. 14, but are illustrated on a left side surface for space limitations.

In Modification 4B, as shown in FIG. 13, the connection position of the oil return pipe 31 to the container 30 is as high as the cylinder 51. Then, the oil introduced from the oil return pipe 31 is released into the space inside the container 30. As shown in FIG. 14, the low-stage compressor 21 of Modification 4C has the pipe 31*q* that is connected to the oil return pipe 31 and guides the oil flow inside the container 30. The pipe 31*q* may be formed integrally with the oil return pipe 31, or the pipe 31*q* as a separate pipe may be connected to the oil return pipe 31 such that the oil flow path is continuous.

In the multistage compression system 20 of Modification 4C, the oil outlet of the oil return pipe in the container is disposed to face a vicinity of the cylinder, and this allows the high-temperature oil to collide with the cylinder 51 more reliably.

(10-4) Modification 4D

In the fourth embodiment, the oil return pipe 31 returns the oil from the oil separator 25 to the low-stage compressor 21. In Modification 4D the oil return pipe 31 directly returns the oil discharged from the high-stage compressor 23 to the low-stage compressor 21. The other configurations are similar to those in the first embodiment.

The multistage compression system 20 of Modification 4D also has similar characteristics (9-1) to (9-3) to the multistage compression system 20 according to the first embodiment. However, in Modification 4D, the excess refrigerant and oil discharged from the high-stage compressor 23 are mixed, and thus the amount of refrigerant mixed in the oil flowing through the oil return pipe 31 is increased as compared with a case where the refrigerant passes through the oil separator 25 in the fourth embodiment.

Further, the oil separated from the oil separator 25 may be added to the oil discharged from the high-stage compressor 23 and returned to the container 30 of the low-stage compressor 21.

The foregoing description concerns the embodiments of the present disclosure. It will be understood that numerous modifications and variations may be made without departing from the gist and scope of the present disclosure in the appended claims.

What is claimed is:

1. A multistage compression system using refrigerant and oil, the multistage compression system comprising:

a low-stage compressor configured to compress the refrigerant;

a high-stage compressor configured to further compress the refrigerant compressed by the low-stage compressor; and an oil return pipe configured to return the oil discharged by the high-stage compressor e oil in the high-stage compressor to the low-stage compressor, the low-stage compressor having a compression part configured to compress the refrigerant, the compression part being a rotary compression part, the compression part including a compression chamber, the refrigerant being introduced into and compressed in the compression chamber, a motor configured to drive the compression part, the motor being disposed above the compression part, and a container housing the compression part and the motor, and the oil return pipe being connected to a space below the motor inside the container, and the oil return pipe being connected above the compression chamber to the container.

2. The multistage compression system according to claim 1, further comprising:

an accumulator configured to separate a liquid component of the refrigerant flowing into the low-stage compressor; and a suction pipe connecting an inside of the accumulator and the compression part, the suction pipe being provided, inside the accumulator, with an oil return hole through which the oil inside the accumulator is sent to the compression part, and the oil return pipe having a flow path cross-sectional area that is larger than an area of the oil return hole.

3. The multistage compression system according to claim 1, further comprising:

an oil cooler in a middle of the oil return pipe.

4. The multistage compression system according to claim 1, further comprising:

a decompressor in a middle of the oil return pipe.

5. The multistage compression system according to claim 1, further comprising:

a flow rate adjusting valve in a middle of the oil return pipe.

6. The multistage compression system according to claim 1, wherein the low-stage compressor further includes an oil guide disposed in the container to face an outlet of the oil return pipe.

7. The multistage compression system according to claim 6, wherein the oil return pipe is disposed such that an angle of an oil introduction part of the oil return pipe into the container is within 15° above and below a horizontal direction.

8. The multistage compression system according to claim 6, wherein the oil guide is disposed within 25% of an inner diameter D of a horizontal cross section of the container from an inner circumference of the container.

9. The multistage compression system according to claim 6, wherein the oil guide is a plate-shaped member extending vertically.

10. The multistage compression system according to claim 9, wherein the motor includes an insulator, and the oil guide is a part continuous to the insulator and extending downward from the insulator.

11. The multistage compression system claim 6, wherein the motor includes a stator, and the oil guide is an outer surface of the stator.

12. The multistage compression system according to claim 6, wherein the oil guide is a bent part of a pipe through which the oil passes.

13. The multistage compression system according to claim 1, wherein the compression part includes a piston arranged and configured to be driven by the motor and a cylinder housing the piston, and the oil return pipe is connected to the container such that the oil having flowed through the oil return pipe is applied to the cylinder or a member in contact with upper and lower parts of the cylinder.

14. The multistage compression system according to claim 13, wherein the compression part further includes a vane partitioning a space between the piston and the cylinder, and a connection position of the oil return pipe to the container is, in a top view, within a range of 120° in a rotation direction of the motor from a rotation center of the motor, where a direction of a center of a cutout part housing the vane on an inner circumference of the cylinder is 0°.

15. The multistage compression system according to claim 13, wherein the oil return pipe is connected to the container such that the oil having flowed through the oil return pipe is applied from above to the cylinder or the member in contact with the upper and lower parts of the cylinder.

16. The multistage compression system according to claim 13, wherein a connection position of the oil return pipe to the container is as high as the cylinder.

17. The multistage compression system according to claim 16, wherein the oil return pipe has a distal end extending closer to the cylinder than the connection position to the container.

18. The multistage compression system according to claim 16, wherein an oil outlet of the oil return pipe in the container is provided so as to face the cylinder or the member in contact with the upper and lower parts of the cylinder.

19. The multistage compression system according to claim 1, wherein the refrigerant mainly includes carbon dioxide, and the oil is insoluble in carbon dioxide.

20. A multistage compression system using refrigerant and oil, the multistage compression system comprising:

a low-stage compressor configured to compress the refrigerant;

a high-stage compressor configured to further compress the refrigerant compressed by the low-stage compressor;

an oil return pipe configured to return the oil discharged by the high-stage compressor or the oil in the high-stage compressor to the low-stage compressor; and an accumulator configured to separate a liquid component of the refrigerant flowing into the low-stage compressor; and a suction pipe, the low-stage compressor having a compression part configured to compress the refrigerant, the compression part being a rotary compression part, a motor configured to drive the compression part, the motor being disposed above the compression part, and a container housing the compression part and the motor, and the oil return pipe being connected to a space below the motor inside the container, the suction pipe connecting an inside of the accumulator and the compression part, the suction pipe being provided, inside the accumulator, with an oil return hole through which the oil inside the accumulator is sent to the compression part, and the oil return pipe having a flow path cross-sectional area that is larger than an area of the oil return hole.

21. A multistage compression system using refrigerant and oil, the multistage compression system comprising:

a low-stage compressor configured to compress the refrigerant;

a high-stage compressor configured to further compress the refrigerant compressed by the low-stage compressor;

an oil return pipe configured to return the oil discharged by the high-stage compressor or the oil in the high-stage compressor to the low-stage compressor; and an oil cooler in a middle of the oil return pipe, the low-stage compressor having a compression part configured to compress the refrigerant, the compression part being a rotary compression part, a motor configured to drive the compression part, the motor being disposed above the compression part, and a container housing the compression part and the motor, and the oil return pipe being connected to a space below the motor inside the container.

22. A multistage compression system using refrigerant and oil, the multistage compression system comprising:

a low-stage compressor configured to compress the refrigerant;

a high-stage compressor configured to further compress the refrigerant compressed by the low-stage compressor;

an oil return pipe configured to return the oil discharged by the high-stage compressor or the oil in the high-stage compressor to the low-stage compressor; and a decompressor in a middle of the oil return pipe, the low-stage compressor having a compression part configured to compress the refrigerant, the compression part being a rotary compression part, a motor configured to drive the compression part, the motor being disposed above the compression part, and a container housing the compression part and the motor, and the oil return pipe being connected to a space below the motor inside the container.

* * * * *